US009022386B2

(12) United States Patent
Kasamai et al.

(10) Patent No.: US 9,022,386 B2
(45) Date of Patent: May 5, 2015

(54) MEDIUM CONVEYING APPARATUS, IMAGE FORMING APPARATUS, MEDIUM CONVEYING SYSTEM, AND MEDIUM CONVEYING METHOD

(71) Applicants: Masashi Kasamai, Kanagawa (JP); Yusuke Ishizaki, Kanagawa (JP); Takahisa Koike, Tokyo (JP)

(72) Inventors: Masashi Kasamai, Kanagawa (JP); Yusuke Ishizaki, Kanagawa (JP); Takahisa Koike, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/321,896

(22) Filed: Jul. 2, 2014

(65) Prior Publication Data

US 2014/0312563 A1 Oct. 23, 2014

Related U.S. Application Data

(62) Division of application No. 13/778,315, filed on Feb. 27, 2013, now abandoned.

(30) Foreign Application Priority Data

Mar. 1, 2012 (JP) ..... 2012-045681
Feb. 5, 2013 (JP) ..... 2013-020387

(51) Int. Cl.
*B65H 5/06* (2006.01)
*B65H 43/00* (2006.01)
*B65H 7/06* (2006.01)

(52) U.S. Cl.
CPC ..... *B65H 5/062* (2013.01); *B65H 43/00* (2013.01); *B65H 7/06* (2013.01); *B65H 2511/417* (2013.01); *B65H 2511/52* (2013.01); *B65H 2513/511* (2013.01); *B65H 2515/32* (2013.01)

(58) Field of Classification Search
CPC ..... B65H 2515/32; B65H 2515/322; B65H 2553/51; B65H 7/02; B65H 5/062; B65H 43/00; B65H 7/06; B65H 2511/417; B65H 2511/52; B65H 2513/511
USPC ..... 271/258.01, 265.01
See application file for complete search history.

(56) References Cited

U.S. PATENT DOCUMENTS 4,396,187 A 8/1983 Landa
4,480,825 A 11/1984 Landa
8,910,939 B2 * 12/2014 Nakura et al. ..... 271/272
2009/0212483 A1 8/2009 Maruyama (Continued)

FOREIGN PATENT DOCUMENTS

JP H09-236958 9/1997

*Primary Examiner* — Jeremy R Severson
(74) *Attorney, Agent, or Firm* — IPUSA, PLLC

(57) ABSTRACT

A medium conveying apparatus includes a conveying status detecting unit configured to determine a conveyance status of a medium based on a driving torque of a driving unit, wherein the conveying unit is configured to convey the medium at a reference speed, the reference speed being faster than the upstream conveying unit at least when the medium is conveyed from the upstream conveying unit, and the reference speed being slower than the downstream conveying unit at least when the medium is conveyed to the downstream conveying unit, and wherein the conveyance status of the medium is detected by the comparison of a prescribed reference torque to the driving torque of the driving unit at least when the medium is conveyed between the upstream conveying unit and the conveying unit or when the medium is conveyed between the conveying unit and the downstream conveying unit.

16 Claims, 18 Drawing Sheets

(56) References Cited

U.S. PATENT DOCUMENTS

2011/0031683 A1* 2/2011 Asari et al. ..... 271/264
2011/0064496 A1 3/2011 Ashikawa
2011/0176846 A1 7/2011 Ishizaki et al.

* cited by examiner

MEDIUM CONVEYING APPARATUS, IMAGE FORMING APPARATUS, MEDIUM CONVEYING SYSTEM, AND MEDIUM CONVEYING METHOD

CROSS-REFERENCE TO RELATED APPLICATIONS

The present application is a divisional of U.S. patent application Ser. No. 13/778,315, filed on Feb. 27, 2013, which is based upon and claims the benefit of priority of Japanese Patent Application Nos. 2012-045681 and 2013-020387 filed on Mar. 1, 2012 and Feb. 5, 2013, respectively. The disclosures of each of these prior applications are hereby incorporated by reference.

BACKGROUND OF THE INVENTION

1. Field of the Invention

The present invention generally relates to a medium conveying apparatus, an image forming apparatus, and a medium conveying system.

2. Description of the Related Art

An image forming apparatus such as a copy machine or a printer has multiple detection sensors (e.g., reflection type optical sensors) provided in its paper conveying path for detecting a paper conveying status (e.g., paper conveying position, paper jam). By making slight adjustments of paper conveying speed according to the output of the detection sensors, the position of the image to be formed on the paper can be accurately matched with a desired position. Thereby, degradation of image quality due to, for example, position deviation can be prevented. In a case where conveying failure (e.g., paper jam) occurs, the location of the conveying failure can be detected according to the output of the detection sensors.

Therefore, the detection sensor that is provided in the paper conveying path plays a significant role in the image forming apparatus. However, providing multiple detection sensors in the paper conveying path increases cost and complicates the structure of the image forming apparatus. This limits the layout inside the image forming apparatus.

In view of the limited layout, there is a known method of detecting a paper jam by detecting the torque of a roller that holds and conveys paper and comparing the value of the detected torque with a predetermined value (see, for example, Japanese Laid-Open Patent Publication No. 9-236958). With this method, paper conveying failure can be detected with a simple configuration requiring no detection sensors.

However, although a paper jam of a conveying unit can be detected with this known method, the paper conveying status cannot be detected in a case where paper is regularly conveyed by the conveying unit. That is, in order to detect paper conveying status other than such a paper jam, a detection sensor or the like is to be provided in the image forming apparatus.

SUMMARY OF THE INVENTION

The present invention may provide a medium conveying apparatus, an image forming apparatus, a medium conveying system, and a medium conveying method that substantially eliminates one or more of the problems caused by the limitations and disadvantages of the related art.

Features and advantages of the present invention will be set forth in the description which follows, and in part will become apparent from the description and the accompanying drawings, or may be learned by practice of the invention according to the teachings provided in the description. Objects as well as other features and advantages of the present invention will be realized and attained by a medium conveying apparatus, an image forming apparatus, a medium conveying system, and a medium conveying method particularly pointed out in the specification in such full, clear, concise, and exact terms as to enable a person having ordinary skill in the art to practice the invention.

To achieve these and other advantages and in accordance with the purpose of the invention, as embodied and broadly described herein, an embodiment of the present invention provides a medium conveying apparatus including a conveying unit including two rotating members for conveying a medium therebetween; a driving unit configured to drive a rotation of at least one of the two rotating members; an upstream conveying unit configured to convey the medium to the conveying unit; a downstream conveying unit configured to receive the medium conveyed from the conveying unit; and a conveying status detecting unit configured to determine a conveyance status of the medium based on a driving torque of the driving unit; wherein the conveying unit is configured to convey the medium at a reference speed, said reference speed being faster than the upstream conveying unit at least when the medium is conveyed from the upstream conveying unit, and said reference speed being slower than the downstream conveying unit at least when the medium is conveyed to the downstream conveying unit; and wherein the conveyance status of the medium is detected by the comparison of a prescribed reference torque to the driving torque of the driving unit at least when the medium is conveyed between the upstream conveying unit and the conveying unit or when the medium is conveyed between the conveying unit and the downstream conveying unit.

Other objects and further features of the present invention will be apparent from the following detailed description when read in conjunction with the accompanying drawings.

DESCRIPTION OF THE PREFERRED EMBODIMENTS

In the following, embodiments of an antenna apparatus of the present invention are described with reference to the accompanying drawings.

[First Embodiment]

<Configuration of Medium Conveying Apparatus>

Figure 1B:
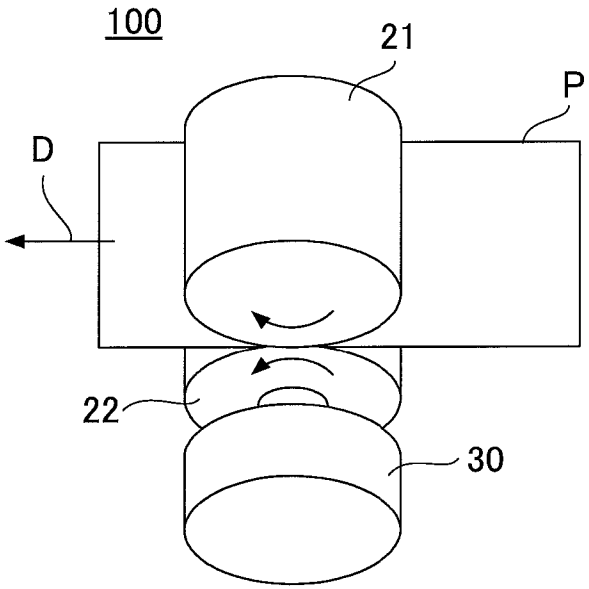
FIGS. 1A and 1B are schematic diagrams illustrating a configuration of a paper conveying apparatus according to the first embodiment of the present invention.
Figure 1A:
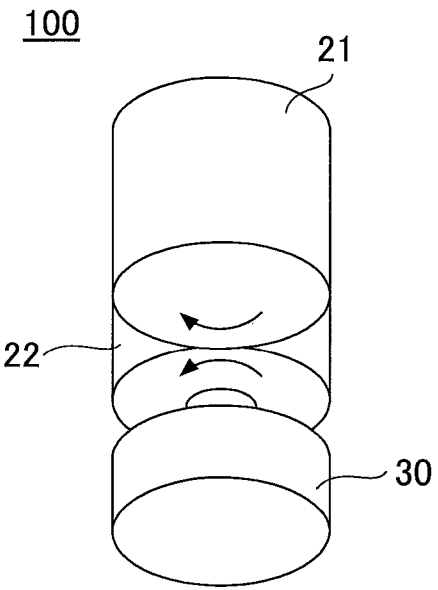

FIGS. 1A and 1B are schematic diagrams illustrating a configuration of a paper conveying apparatus (medium conveying apparatus) 100 according to the first embodiment of the present invention.

As illustrated in FIGS. 1A and 1B, the paper conveying apparatus 100 includes two conveying rollers (rotating members) 21, 22 and a motor (driving unit) 30 that drives the conveying roller 22 to rotate. A sheet(s) of paper P, which is conveyed from an upstream conveying unit or the like (not illustrated), is held between the conveying rollers 21, 22 and conveyed by the conveying rollers 21, 22. The conveying roller 22 is rotated by the motor 30 in the arrow direction as illustrated in FIG. 1A. The conveying roller 21, which is positioned in contact with the conveying roller 22, is configured to subordinately rotate with the rotation of the conveying roller 22.

The conveying rollers 21, 22 holds the paper P therebetween and conveys the paper D in the arrow direction D as illustrated in FIG. 1B by receiving a driving force of the motor 30.

Figure 2:
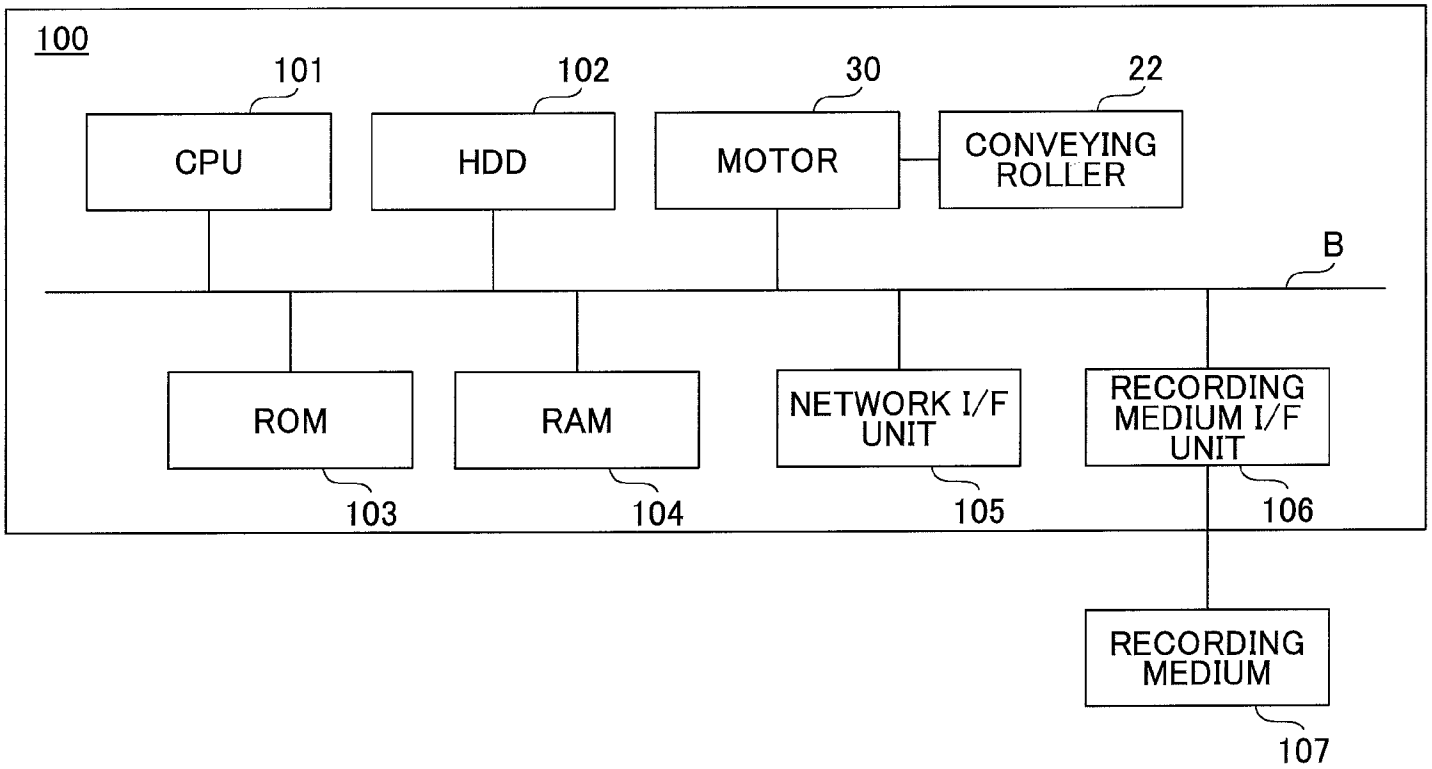
FIG. 2 is a schematic diagram illustrating a hardware configuration of a paper conveying apparatus according to the first embodiment of the present invention.

FIG. 2 is a schematic diagram illustrating a hardware configuration of the paper conveying apparatus 100 according to the first embodiment of the present invention.

As illustrated in FIG. 2, in addition to the above-described conveying rollers 21, 22, and the motor 30, the paper conveying apparatus 100 also includes, for example, a CPU (Central Processing Unit) 101, a HDD (Hard Disk Drive) 102, a ROM (Read Only Memory) 103, a RAM (Random Access Memory) 104, a network I/F (interface) unit 105, a recording medium I/F unit 106 that are connected to each other by a bus B.

The CPU 101 is an operation device that performs controls and calculation/processing of data inside a computer. The CPU 101 executes programs stored in, for example, the ROM 103 and the RAM 104. By executing the programs, the CPU 101 controls the entire paper conveying apparatus 100 and implements the functions of the below-described functions units (e.g., torque calculating unit 51, paper detecting unit 52).

The HDD 102 is a non-volatile storage device that stores various programs and data therein. The programs and data stored by the HDD 102 include, for example, an OS (Operating System) and applications for providing various functions.

The ROM 103 is a non-volatile semiconductor memory (storage device) that stores data (e.g., internal data of the paper conveying apparatus 100) therein even after power is turned off. Further, the RAM 104 is a volatile semiconductor memory (storage device) that temporarily stores, for example, programs and data therein.

The network I/F unit 105 is an interface for communicating with a peripheral device(s) having a communication function by way of a network (e.g., LAN (Local Area Network), WAN (Wide Area Network)) constituted by wired and/or wireless data transmission paths.

The recording medium I/F unit 106 is an interface for reading/writing data with respect to a recording medium (computer-readable recording medium) 107. The recording medium 107 may be, for example, a flash memory connected by a data transmission path (e.g., USB (Universal Serial Bus)), a CD-ROM, a flexible disk (FD), a CD-R, and a DVD (Digital Versatile Disk).

The recording medium 107 has a predetermined program stored (recorded) therein. The program stored in the recording medium 107 is installed in the paper conveying apparatus 100 by way of the recording medium I/F unit 106, so that the installed program can be executed by the CPU 101.

Figure 3:
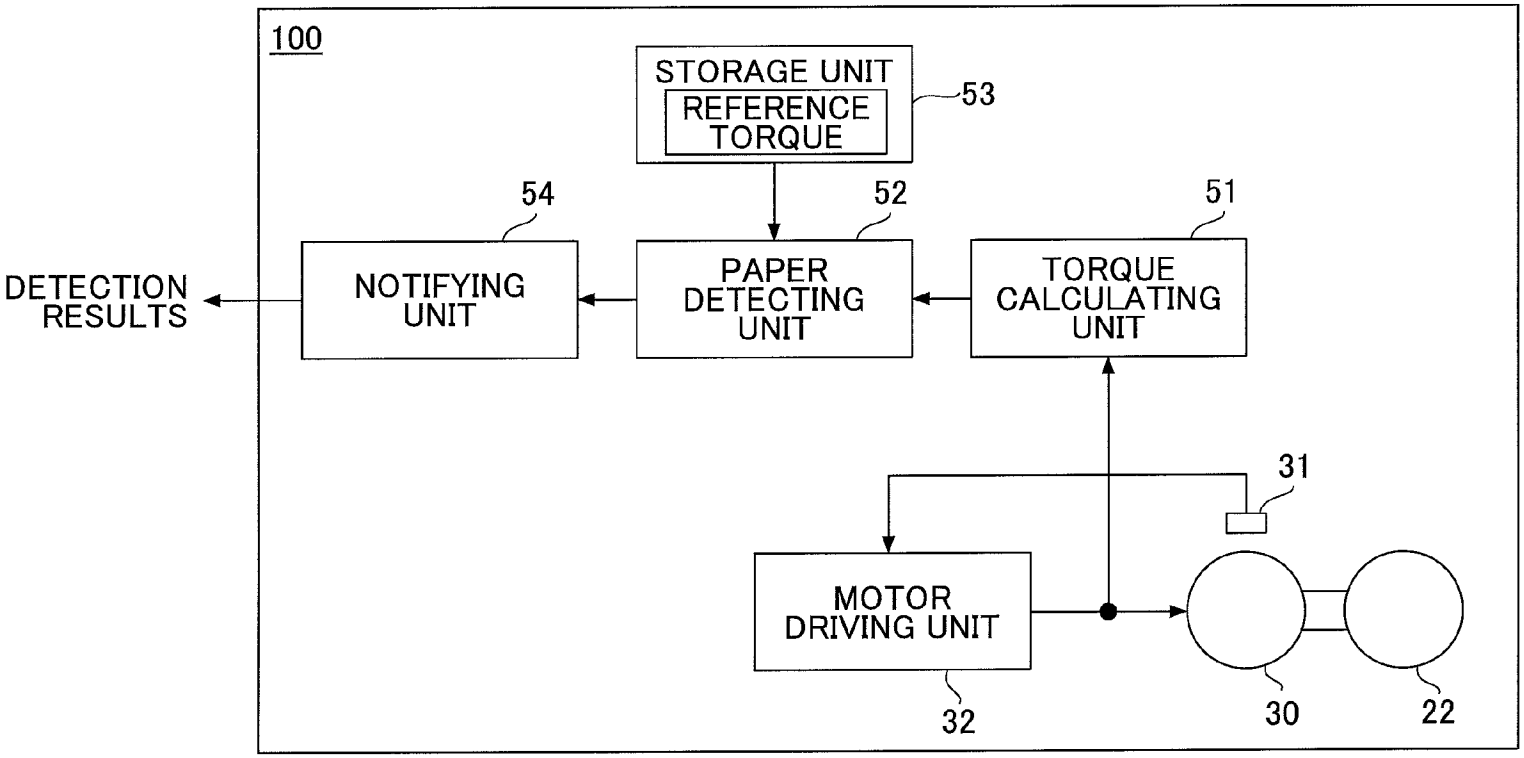
FIG. 3 is a block diagram illustrating a configuration of function parts of a paper conveying apparatus according to the first embodiment of the present invention.

FIG. 3 is a block diagram illustrating a configuration of function parts of the paper conveying apparatus 100 according to the first embodiment of the present invention.

The paper conveying apparatus 100 of the first embodiment includes, for example, the motor 30 for driving the rotation of the conveying roller 22, an encoder 31, a motor driving unit 32, a torque calculating unit 51, a paper detecting unit (medium detecting unit) 52, a storage unit 53, and a notifying unit 54.

The encoder 31, which is placed on a rotation shaft of the motor 30, outputs signals corresponding to the rotation speed of the motor 30 to the motor driving unit 32.

The motor driving unit 32 calculates the rotation speed of the motor 30 based on the signals output from the encoder 31 and controls the rotation speed of the motor 30 to a desired rotation speed.

The torque calculating unit 51 calculates the torque (driving torque) of the motor 30 based on the driving voltage input to the motor 30. The driving torque of the motor can be obtained by the following formula. It is to be noted that the torque calculating unit 51 is one example of a parameter calculating unit that calculates a parameter(s) and a reference parameter(s) of the motor 30. In this embodiment, the parameter includes the torque of the motor 30 and the below-described reference torque of the motor 30.

[Formula 1]

$$T = Kt \times \frac{Vm - Ke \times N}{Ra} \quad (1)$$

In Formula 1, "T" represents the torque of the motor 30, "Kt" represents the torque constant, "Vm" represents the driving voltage of the motor 30, "Ke" represents the induction voltage constant, "N" represents the number of rotations of the motor 30, and "Ra" represents the armature resistance of the motor 30. "Kt", "Ke", and "Ra" are unique constants of the motor 30. The driving torque of the motor 30 can be calculated by measuring "Vm" and "N".

The paper detecting unit 52 determines whether the paper P is being conveyed by the conveying rollers 21, 22 based on a comparison between a reference torque and a torque calculation result calculated by the torque calculating unit 51. The reference torque is calculated beforehand (i.e. before the determination) by the torque calculating unit 51 in a state where the paper P is not being conveyed by the conveying rollers 21, 22.

The storage unit 53 includes the above-described ROM 103 and/or the RAM 104. The storage unit 53 stores the reference torque calculated by the torque calculating unit 51 in a state where the paper P is not being conveyed by the conveying rollers 21, 22.

The notifying unit 54 notifies the result of the determination (detection result) by the paper detecting unit 52 to, for example, an external device (e.g., server or the like) outside of the paper conveying apparatus 100 via a network.

<Paper Detection>

Next, a method for detecting paper with the paper detecting unit 52 is described.

Figure 4:
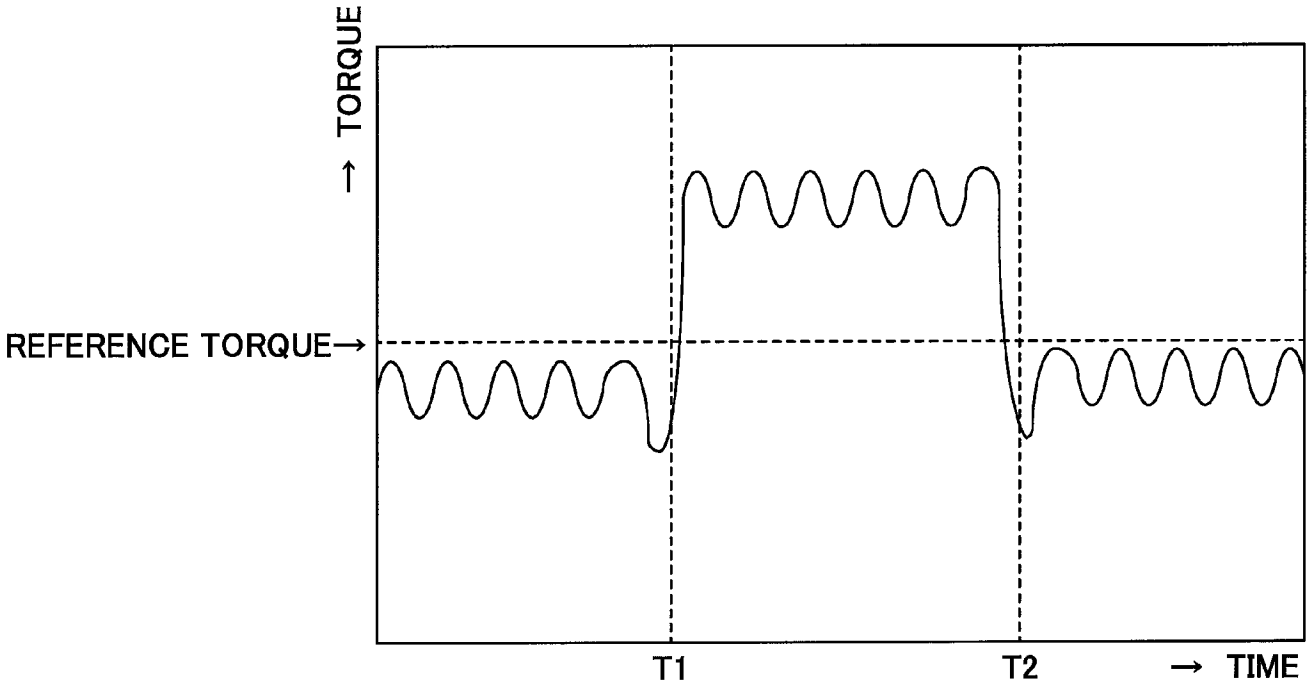
FIG. 4 is a schematic diagram illustrating changes of a torque of a motor in a case where a sheet of paper is being conveyed in a paper conveying apparatus according to the first embodiment of the present invention.

FIG. 4 is a schematic diagram illustrating changes of the torque of the motor 30 in a case where the paper P is being conveyed in the paper conveying apparatus 100 of the first embodiment.

The example of FIG. 4 illustrates the changes of torque when a front end of the paper P enters an area between the conveying rollers 21, 22 at time T1, when the paper P is conveyed by the conveying rollers 21, 22 during a period between time T1 and time T2, and when a rear end of the paper passes the area between the conveying rollers 21, 22 at time T2.

As illustrated in FIG. 4, the torque during the period in which the paper P is being conveyed by the conveying rollers 21, 22 becomes higher compared to the torque when the paper P is not conveyed by the conveying rollers 21, 22. Accordingly, the detection of the paper P conveyed by the conveying rollers 21, 22 can be performed by setting a reference torque, for example, within a range between the torque obtained when the paper P is being conveyed by the conveying rollers 21, 22 and a torque obtained when the paper P is not conveyed by the conveying rollers 21, 22, and comparing the set reference torque with a torque that is calculated when the paper P is being conveyed in the paper conveying apparatus 100.

As described above, the reference torque is set beforehand based on a torque calculated by the torque calculating unit 51 in a state where the paper P is not conveyed by the conveying rollers 21, 22. Further, the set reference torque is stored in the storage unit 53. The value of the reference torque is set to be within a range between the torque obtained when the paper P is being conveyed by the conveying rollers 21, 22 and the torque obtained when the paper P is not conveyed by the conveying rollers 21, 22. It is preferable for the value of the reference torque to be near a maximum value of the torque obtained when the paper P is not conveyed by the conveying rollers 21, 22.

Thus, by setting the reference torque, storing the reference torque in the storage unit 53, and using the paper detecting unit 52 to compare the reference torque with a torque calculated by the torque calculating unit 51 during the conveying of the paper P in the paper conveying apparatus 100, the detection of the paper P conveyed by the conveying rollers 21, 22 can be performed by setting a reference torque within a range between the torque obtained when the paper P is being conveyed by the conveying rollers 21, 22 and a torque obtained when the paper P is not conveyed by the conveying rollers 21, 22, and comparing the set reference torque with a torque calculated when the paper P is conveyed in the paper conveying apparatus 100.

<Paper Detection Process>

Figure 5:
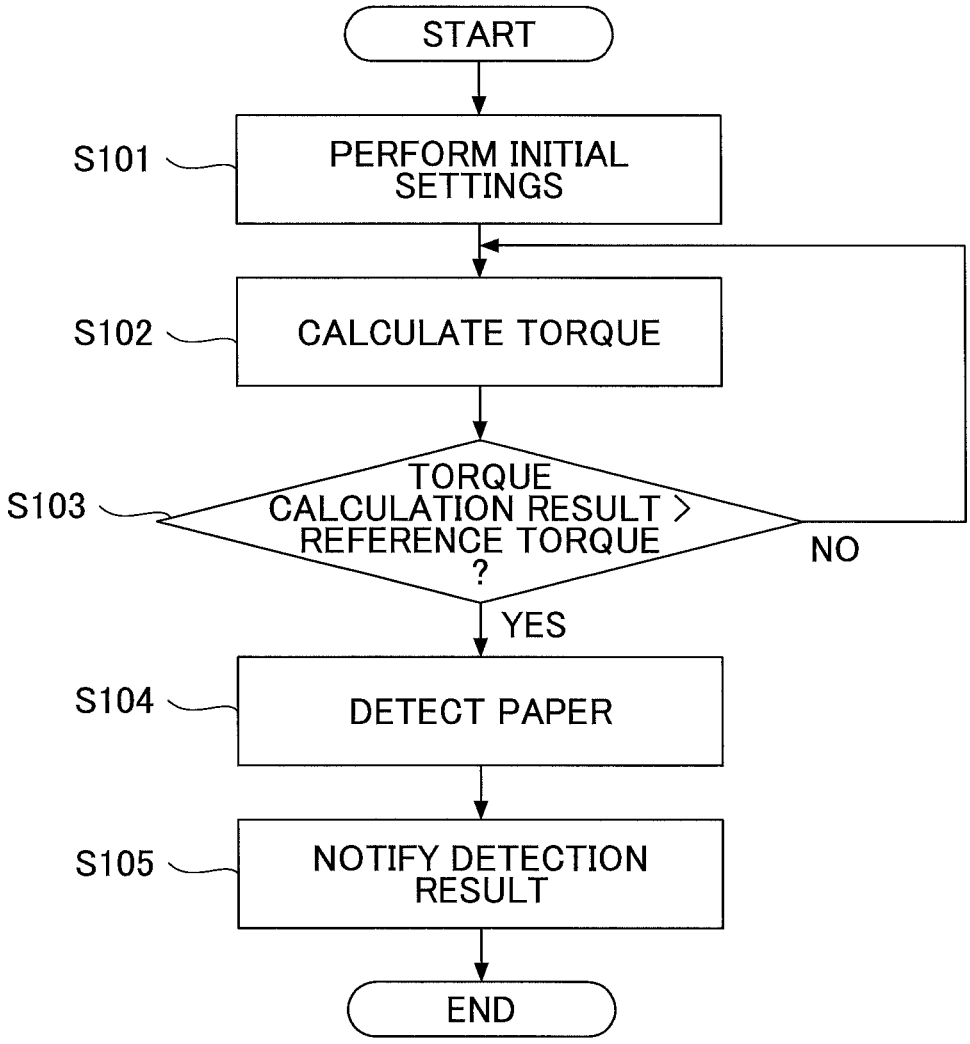
FIG. 5 is a flowchart illustrating a paper detection process by a paper conveying apparatus according to the first embodiment of the present invention.

FIG. 5 is a flowchart illustrating a paper detection process by the paper conveying apparatus 100 of the first embodiment.

In a case of conveying the paper P with the paper conveying apparatus 100, first, initial setting is performed (Step S101). In Step S101, the paper detecting unit 52 reads out a reference torque from the storage unit 53. Then, the torque calculating unit 51 calculates a torque of the motor 30 being driven to rotate (Step S102). Then, the paper detecting unit 52 compares the result of the calculation (torque calculation result) of the torque calculating unit 51 with the reference torque (Step S103). In a case where the torque calculation result is greater than the reference torque (Yes in Step S103), the paper detecting unit 52 determines that the paper P is being conveyed by the conveying rollers 21, 22 (Step S104). Then, the notifying unit 54 notifies the result of the determination (detection result) of the paper detecting unit 52 to, for example, a server or the like (Step S105). Thereby, the paper detection process is terminated.

Accordingly, by calculating the torque of the motor 30 for rotating the conveying roller 22 and comparing the calculated torque with the reference torque (obtained when the paper P is not conveyed by the conveying rollers 21, 22), detection of the paper P conveyed by the conveying rollers 21, 22 can be performed. Hence, with the paper conveying apparatus 100 of the first embodiment, there is no need to provide a paper detection sensor or the like in front of and/or behind the conveying rollers 21, 22 in a conveying path of the paper P. Thus, the paper P can be conveyed with the paper conveying apparatus 100 having a simple configuration.

It is to be noted that other media besides the paper P may be conveyed by the paper conveying apparatus 100. For example, the paper conveying apparatus 100 may convey a sheet-like medium such as OHP (Over Head Projector) medium, a postcard, an envelope, or cloth. Hence, even in a case where a medium besides the paper P is used, the medium conveyed by the conveying rollers 21, 22 can be detected.

[Second Embodiment]

Next, the paper conveying apparatus 200 according to the second embodiment of the present invention is described. In the second embodiment of the present invention, components corresponding to the above-described paper conveying apparatus 100 of the first embodiment are denoted with like reference numerals, and are not further explained.

<Configuration of Paper Conveying Apparatus>

Figure 6:
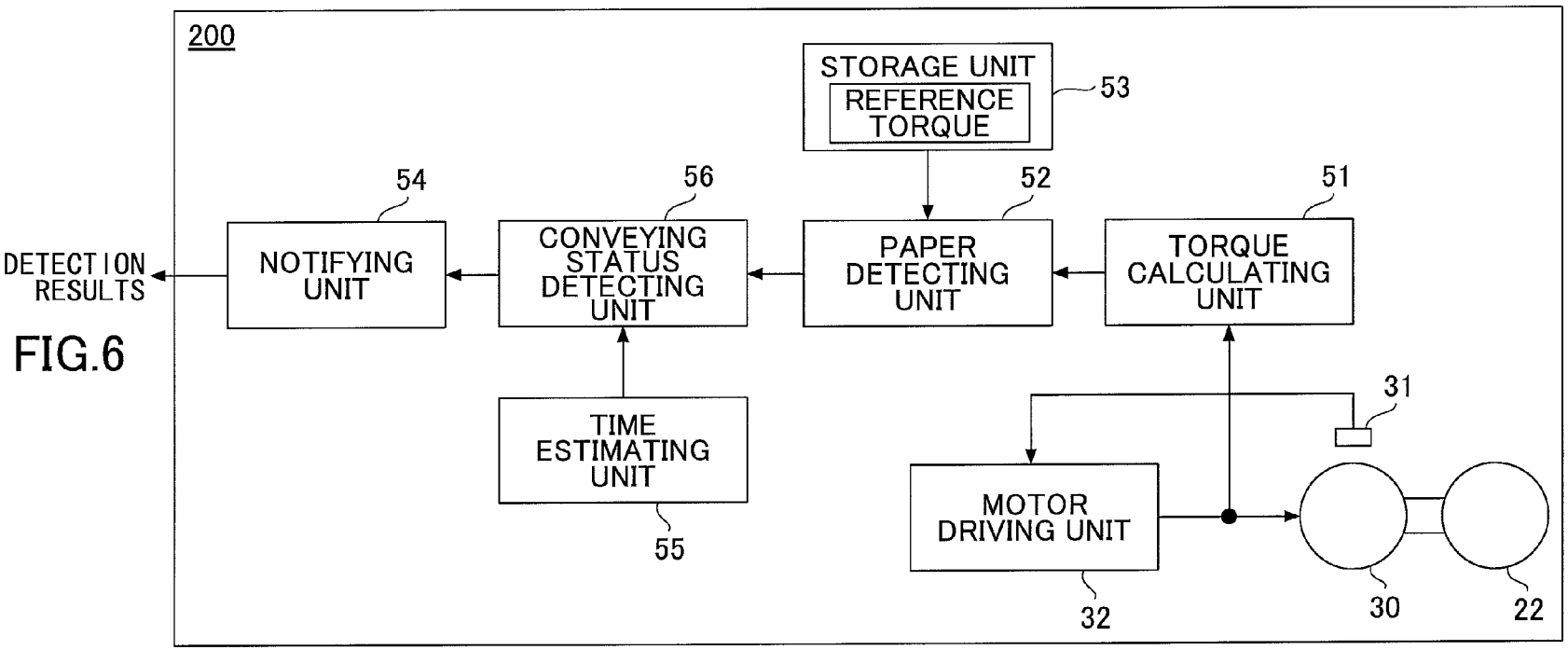
FIG. 6 is a block diagram illustrating a configuration of function parts of a paper conveying apparatus according to the second embodiment of the present invention.

FIG. 6 is a block diagram illustrating a configuration of function parts of the paper conveying apparatus 200 according to the second embodiment of the present invention.

As illustrated in FIG. 6, the difference between the configuration of the paper conveying apparatus 200 of the second embodiment and the paper conveying apparatus 100 of the first embodiment is mainly that the paper conveying apparatus 200 of the second embodiment includes a time estimating unit 55 and a conveying status detecting unit 56.

The time estimating unit 55 estimates, for example, the time when the paper P reaches the area between the conveying rollers 21, 22 with respect to a predetermined reference time or the time when the paper P passes the area between the conveying rollers 21, 22 with respect to the predetermined reference time. The time estimating unit 55 estimates times based on, for example, the distance of a paper conveying path, the paper conveying speed, and/or the paper size. The predetermined reference time may be, for example, the time when the paper P is fed from a paper tray (not illustrated) of the paper conveying apparatus 200, or the time when the paper P passes through a conveying unit (not illustrated) located on an upstream side of the conveying rollers 21, 22.

The conveying status detecting unit 56 detects a status of conveying the paper P with the conveying rollers 21, 22 (hereinafter also referred to "paper conveying status" or simply "conveying status"). The detection of the conveying status is performed based on, for example, the detection result of the paper P by the paper detecting unit 52 and the estimation time estimated the time estimating unit 55.

Similar to the first embodiment, the storage unit 53 stores the reference torque that is set based on the torque calculated by the torque calculating unit 51 in a state where the paper P is not conveyed by the conveying rollers 21, 22. The paper detecting unit 52 detects the paper P conveyed by the conveying rollers 21, 22 based on, for example, the reference torque stored in the storage unit 53.

<Conveying Status Detection>

Figure 7A:
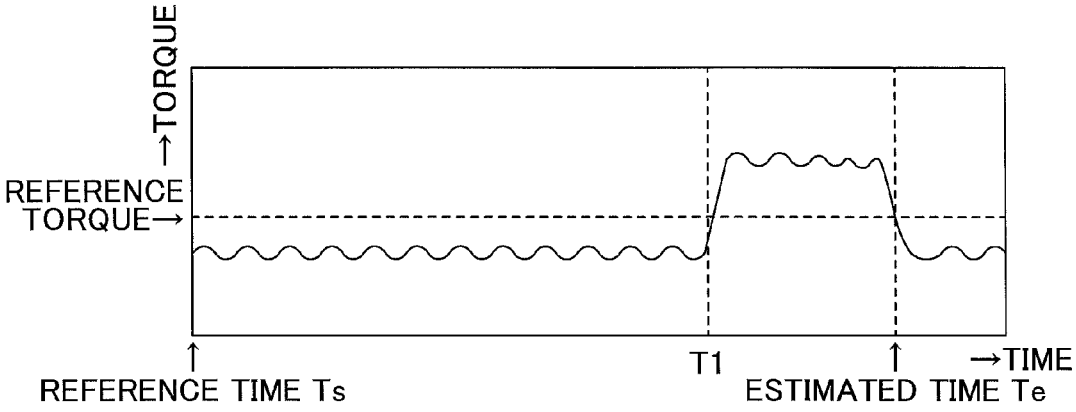
FIGS. 7A-7C are schematic diagrams illustrating changes of a torque of a motor of a paper conveying apparatus according to the second embodiment of the present invention.
Figure 7B:
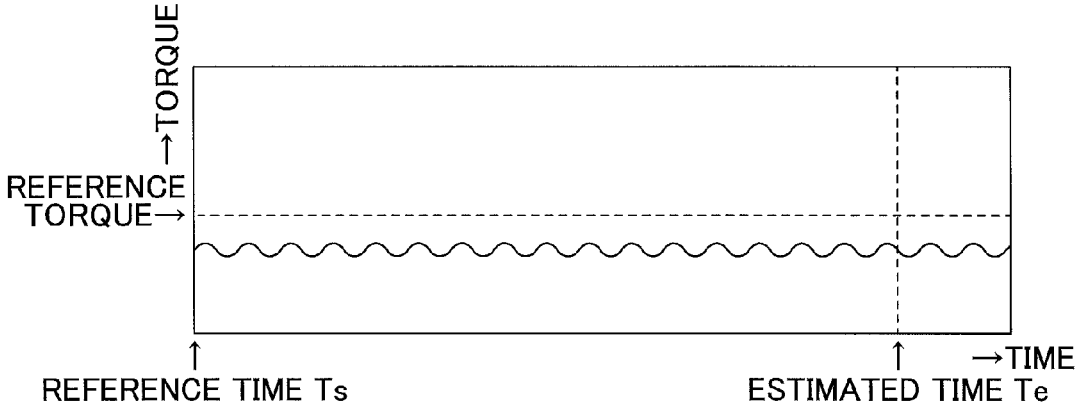
Figure 7C:
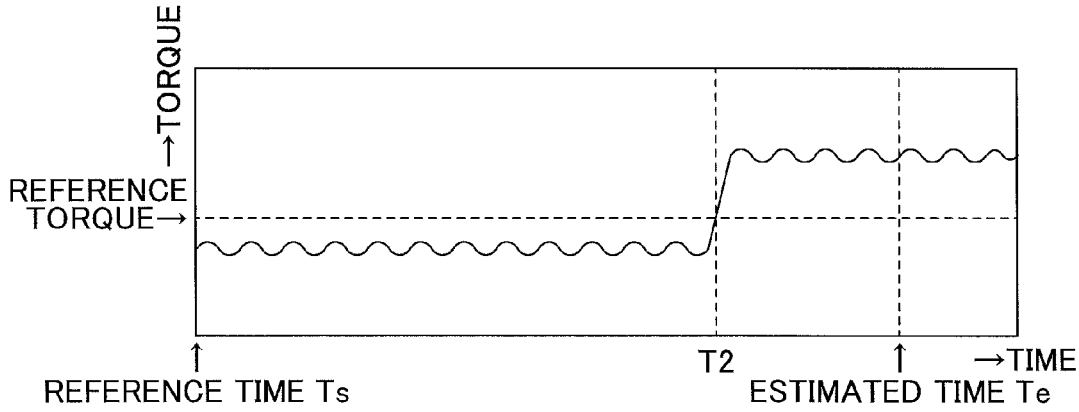

FIGS. 7A-7C are schematic diagrams illustrating the changes of torque of the motor 30 of the paper conveying apparatus 200 according to the second embodiment of the present invention. In FIGS. 7A-7C, reference time "Ts" indicates the time when the paper P is fed to the paper conveying apparatus 200. Further, estimated time "Te" indicates the time estimated by the time estimating unit 55. In this example, the estimated time "Te" indicates the estimated time in which the paper P passes between the conveying rollers 21, 22.

In FIG. 7A, the torque calculation result of the torque calculating unit 51 is less than or equal to the reference torque during a period between the reference time Ts and the time T1. Then, the torque calculation result of the torque calculating unit 51 becomes higher than the reference torque during a period between the time T1 and the estimated time Te. Then, the torque calculation result of the torque calculating unit 51 becomes less than or equal to the reference torque after the estimated time Te. Therefore, in a case where the torque is calculated as described above, the paper P is regularly conveyed and passes between the conveying rollers 21, 22.

FIG. 7B illustrates a case where the torque calculation result of the torque calculating unit 51 is less than or equal to the reference torque during a period between the reference time Ts and the estimated time Te. This case illustrated in FIG. 7B represents a case where the paper P has not reached the area between the conveying rollers 21, 22 due to some kind of conveying failure that has occurred before the paper P has reached the area between the conveying rollers 21, 22.

In FIG. 7C, the torque calculation result of the torque calculating unit 51 is less than or equal to the reference torque during a period between the reference time Ts and the time T2. Then, the torque calculation result of the torque calculating unit 51 becomes greater than the reference torque not only during a period between the time T2 and the estimated time Te but even after the estimated time T2. This case, illustrated in FIG. 7C, represents a case where the paper P has reached the area between the conveying rollers 21, 22 but has run into an irregular conveying failure (e.g., paper jam) at the area between conveying rollers 21, 22.

As illustrated in FIGS. 7A-7C, by comparing the reference torque and the torque calculation result calculated before and after the estimated time Te with the torque calculating unit 51, the paper conveying status of the conveying rollers 21, 22 can be detected.

<Conveying Status Detection Process>

Figure 8:
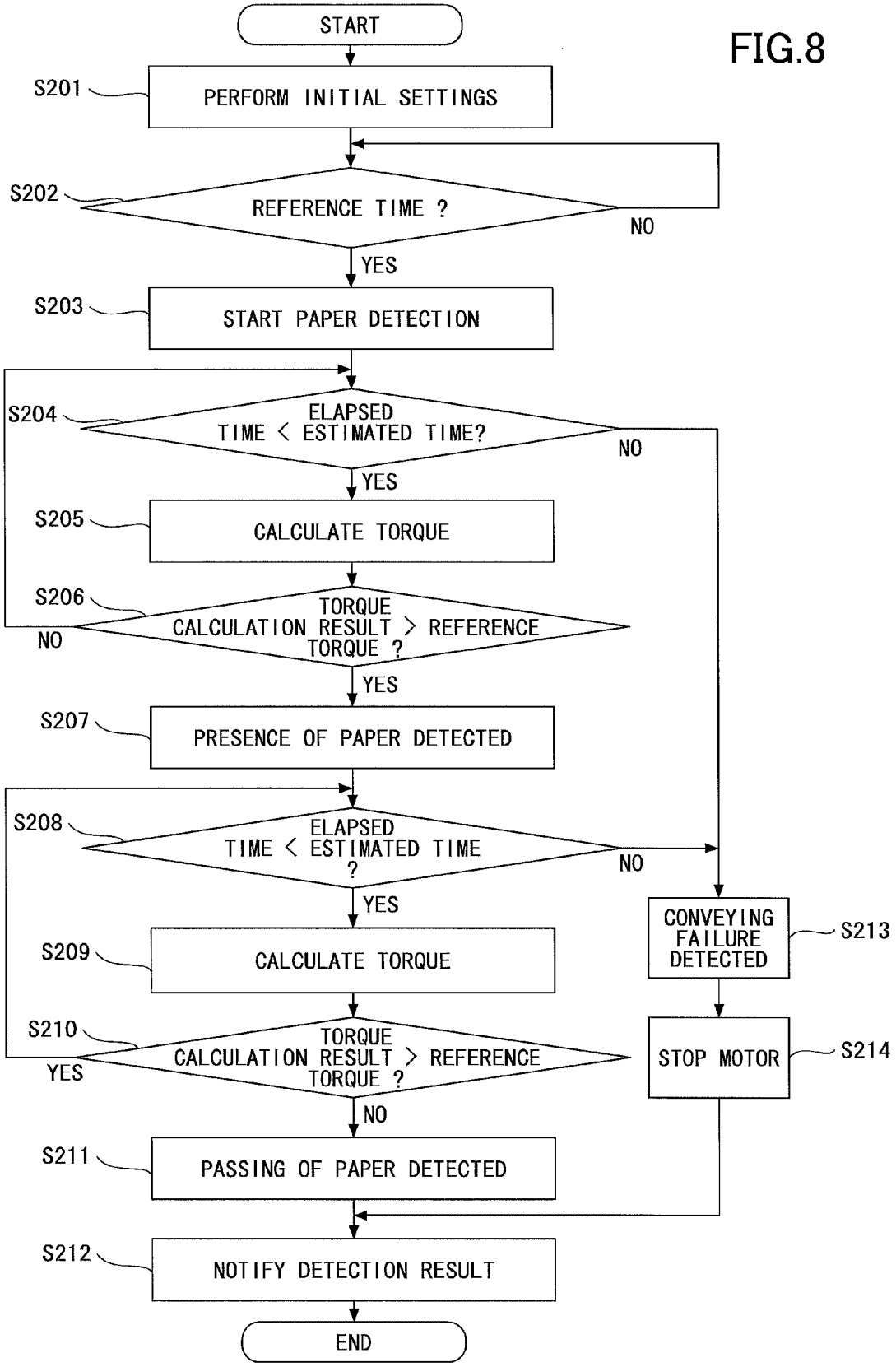
FIG. 8 is a flowchart illustrating a process for detecting a paper conveying status of a paper conveying apparatus according to the second embodiment of the present invention.

FIG. 8 is a flowchart illustrating a process for detecting the paper conveying status of the paper conveying apparatus 200 of the second embodiment.

At the time of beginning the conveying of the paper P with the paper conveying apparatus 200 of the second embodiment, first, initial settings are performed (Step S201). In the initial settings of Step S201, the paper detecting unit 52 reads out a reference torque from the storage unit 53. Then, the time estimating unit 55 sets a reference time and estimates the time in which the paper P passes the conveying rollers 21, 22 with respect to the reference time. Because the below-described detection of conveying status is based on the estimated time, the time estimating unit 55 is required to estimate the time in which the paper P passes the conveying rollers 21, 22 in a case where the paper P is regularly conveyed.

Then, it is determined whether the reference time has been reached (Step S202). In a case of reaching the reference time (Yes in Step S202), the torque calculating unit 51 begins to calculate the torque of the motor 30, and the paper detecting unit 52 begins detection of the paper P (Step S203). Then, it is determined whether the time elapsed from the reference time is less than the time estimated by the time estimating unit 55 (Step S204). In a case where the elapsed time is less than the estimated time (Yes in Step S204), the torque calculating unit 52 continues to calculate the torque of the motor 30 (Step S205). Then, the paper detecting unit 52 compares the torque calculation result with the reference torque and determines whether the torque calculation result is greater than the reference torque (Step S206). In a case where the torque calculation result is greater than the reference torque (Yes in Step S206), it is determined that the paper P is conveyed to the area between the conveying rollers 21, 22 (Step S207).

After the paper P to be conveyed by the conveying rollers 21, 22 is detected, it is again determined whether the time elapsed from the reference time is less than the time estimated by the time estimating unit 55 (Step S208). In a case where the elapsed time is less than the estimated time (Yes in Step S208), the torque calculating unit 51 continues to calculate the torque of the motor 30 (Step S209). Then, the paper detecting unit 52 compares the torque calculation result with the reference torque and determines whether the torque calculation result is greater than the reference torque (Step S210). In a case where the torque calculation result is less than the reference torque (No in Step S210), the paper detecting unit 52 determines that the paper P has passed the area between the conveying rollers 21, 22 (Step S211). In the case where the paper P has been determined to be conveyed to the area between the conveying rollers 21, 22 in Step S207 and determined to have passed the area between the conveying rollers 21, 22 in Step S211, the notifying unit 54 notifies, for example, the server or the like that the paper P has be regularly conveyed (Step S212).

If the torque calculation result has not surpassed the reference torque (No in Step S206) in a case where time has elapsed beyond the estimated time (No in Step S204), it is determined that conveying failure has occurred before the paper P has reached the area between the conveying rollers 21, 22 as illustrated in FIG. 7B. Therefore, in this case, the conveying status detecting unit 56 determines that conveying failure has occurred (Step S213). Accordingly, the motor 30 is stopped (Step S214). Then, the notifying unit 54 notifies, for example, a server or the like that conveying failure has been detected (Step S212). Thereby, the process of detecting the conveying status is terminated.

Further, if the torque calculation result has surpassed the reference torque (Yes in Step S210) in a case where time has elapsed beyond the estimated time (No in Step S208), it is determined that conveying failure (e.g., paper jam) has occurred at the area between the conveying rollers 21, 22 as illustrated in FIG. 7C. Therefore, in this case, the conveying status detecting unit 56 determines that conveying failure has occurred (Step S213). Accordingly, the motor 30 is stopped (Step S214). Then, the notifying unit 54 notifies, for example, a server or the like that conveying failure has been detected (Step S212). Thereby, the process of detecting the conveying status is terminated.

Thus, by estimating the time in which the paper P passes the conveying rollers 21, 22 and referring to the torque calculation result calculated before and after the estimated time, the paper conveying status of the conveying rollers 21, 22 can be detected.

In an alternative case, the time estimating unit 55 may estimate the period of time in which the paper P is being conveyed by the conveying rollers 21, 22 after the paper P has reached and entered the area between the conveying rollers 21, 22 (entry time). In this alternative case, the conveying status detecting unit 56 determines the conveying status of the paper P based on the entry time estimated by the time estimating unit 55. In other words, it is determined that the paper P is being regularly conveyed by the conveying rollers 21, 22 if the torque calculation result calculated by the torque calculating unit 51 is greater than the reference torque during the estimated entry time. Alternatively, the conveying status detecting unit 56 may obtain the estimated entry time and an estimated time in which the paper P has passed the area between the conveying rollers 21, 22 (estimated passing time). Thereby, the conveying status detecting unit may determine the conveying status of the paper P by referring the torque calculation results corresponding to multiple estimated times (e.g., estimated entry time, estimated passing time).

[Third Embodiment]

Next, a paper conveying apparatus 300 according to the third embodiment of the present invention is described. In the third embodiment of the present invention, components corresponding to the above-described paper conveying apparatuses 100, 200 of the first and second embodiments are denoted with like reference numerals, and are not further explained.

<Configuration of Paper Conveying Apparatus>

Figure 9:
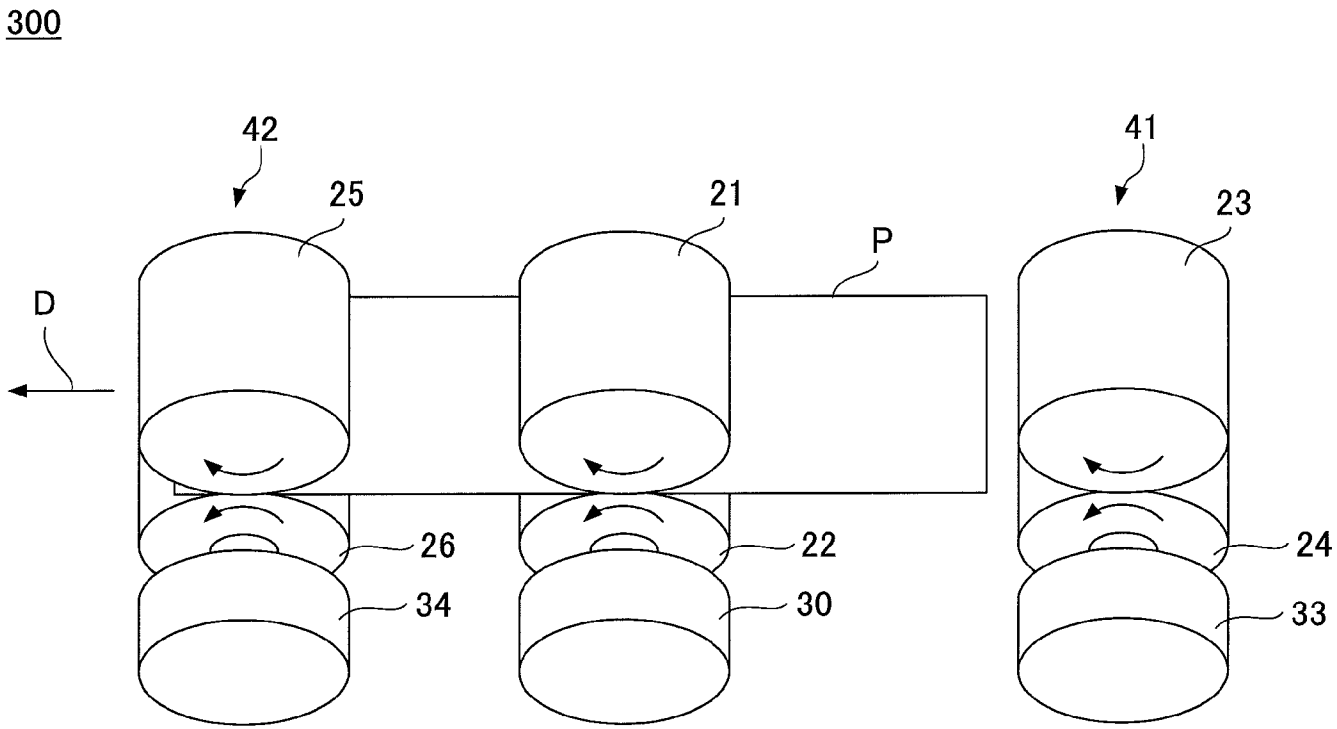
FIG. 9 is a schematic diagram illustrating a configuration of a paper conveying apparatus according to the third embodiment of the present invention.

FIG. 9 is a schematic diagram illustrating a configuration of the paper conveying apparatus 300 according to the third embodiment of the present invention.

As illustrated in FIG. 9, the paper conveying apparatus 300 of the third embodiment includes an upstream conveying unit 41 located upstream of the conveying rollers 21, 22 in a paper conveying direction (direction of arrow D in FIG. 9), and a downstream conveying unit 42 located downstream of the conveying rollers 21, 22 in the paper conveying direction. The upstream conveying unit 41 includes conveying rollers 23, 24. The downstream conveying unit 42 includes conveying rollers 25, 26. The paper P is conveyed in the direction of arrow D. In the configuration of FIG. 9, the paper P is fed from the upstream conveying unit 41 to the conveying rollers 21, 22 and then to the downstream conveying unit 42 from the conveying rollers 21, 22.

The upstream conveying unit 41 also includes a motor 33. Accordingly, the motor 33 drives the conveying roller 24 to rotate in the arrow direction illustrated in FIG. 9. Further, the conveying roller 23 is driven to rotate in correspondence with the rotation of the conveying roller 24 in the arrow direction illustrated in FIG. 9.

Similar to the upstream conveying unit 41, the downstream conveying unit 42 also includes a motor 34. Likewise, the motor 33 drives the conveying roller 26 to rotate in the arrow direction illustrated in FIG. 9. Further, the conveying roller 25 is driven to rotate in correspondence with the rotation of the conveying roller 26 in the arrow direction illustrated in FIG. 9.

Figure 10:
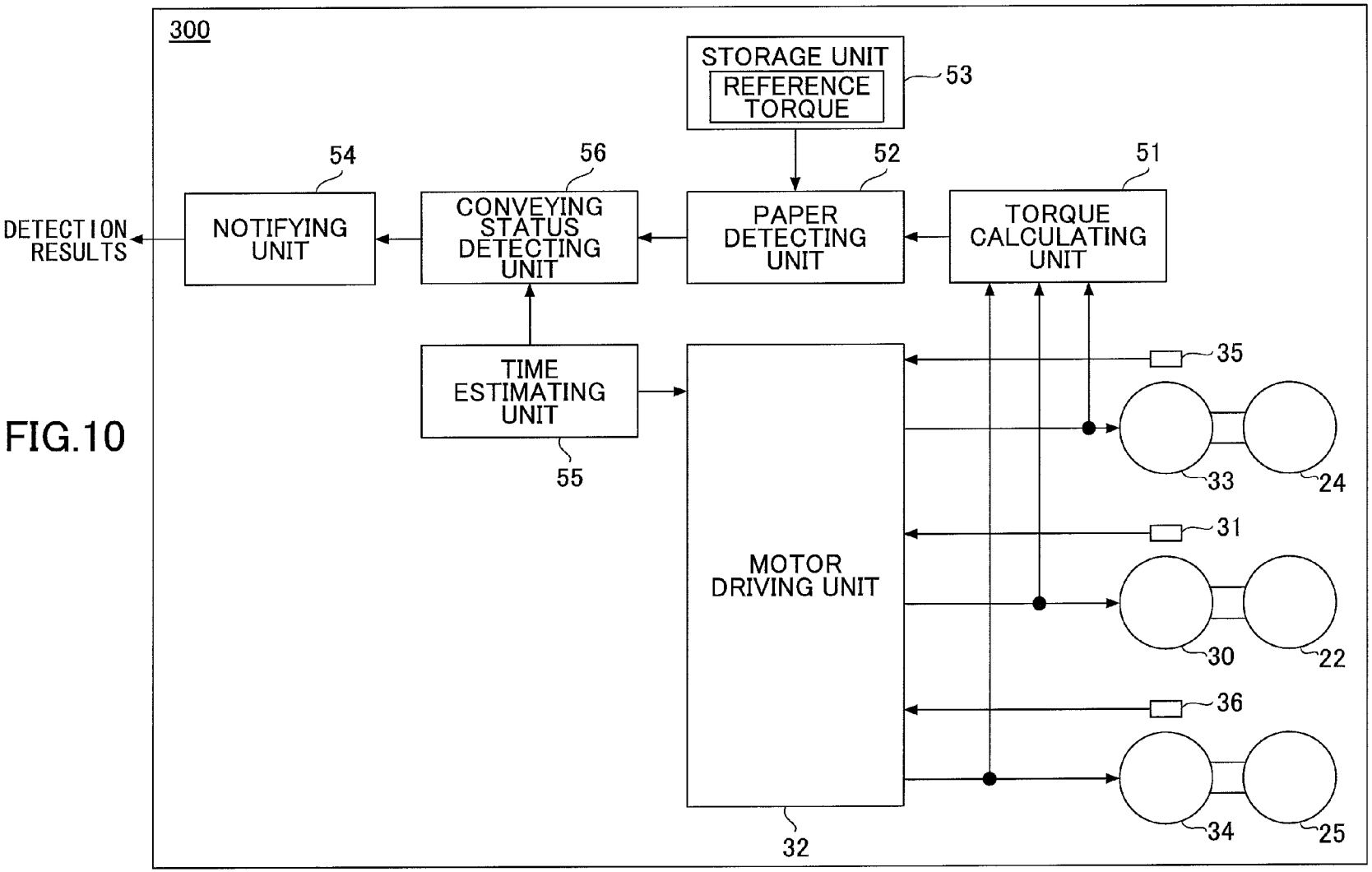
FIG. 10 is a block diagram illustrating a configuration of function parts of a paper conveying apparatus according to the third embodiment of the present invention.

FIG. 10 is a block diagram illustrating a configuration of function parts of the paper conveying apparatus 300 according to the third embodiment of the present invention.

The upstream conveying unit 41 has an encoder 35 placed on a rotation shaft of the motor 33. The encoder 35 outputs signals corresponding to the rotation speed of the motor 33 to the motor driving unit 32. The motor driving unit 32 calculates the rotation speed of the motor 33 based on the signals output from the encoder 35 and controls the rotation speed of the motor 33.

Similar to the upstream conveying unit 41, the downstream conveying unit 42 also has an encoder 36 placed on a rotation shaft of the motor 34. The encoder 36 outputs signals corresponding to the rotation speed of the motor 34 to the motor driving unit 32. The motor driving unit 32 calculates the rotation speed of the motor 34 based on the signals output from the encoder 36 and controls the rotation speed of the motor 34.

The torque calculating unit 51 calculates the driving torques of the motors 30, 33, and 34 by using the above-described formula (1).

The paper detecting unit 52 can detect the paper P conveyed by each of the upstream conveying unit 41, the conveying rollers 21, 22, and the downstream conveying unit 42 based on corresponding reference torques stored in the storage unit 53. The reference torques are set beforehand based on a torque calculated by the torque calculating unit 51 in a state where the paper P is not conveyed by the upstream conveying unit 41, the conveying rollers 21, 22, and the downstream conveying unit 42, respectively.

The time estimating unit 55 estimates the time when the paper P reaches the upstream conveying unit 41, the area between the conveying rollers 21, 22, and the downstream conveying unit 42 with respect to the reference time, respectively. The time estimating unit 55 also estimates the time when the paper P passes the upstream conveying unit 41, the area between the conveying rollers 21, 22, and the downstream conveying unit 42 with respect to the reference time, respectively.

The motor driving part 32 obtains the estimated time from the time estimating unit 55 and controls the driving of the motor 30, 33, 34 based on the estimated time.

The conveying status detecting unit 56 determines (detects) the paper conveying status of each of the upstream conveying unit 41, the conveying rollers 21, 22, and the downstream conveying unit 42 based on the detection result of the paper detecting unit 52 and the estimated time of the time estimating unit 55. Further, the conveying status detecting unit 56 notifies the detected paper conveying status to an external device (e.g., server or the like).

<Paper Detection>

Figure 11:
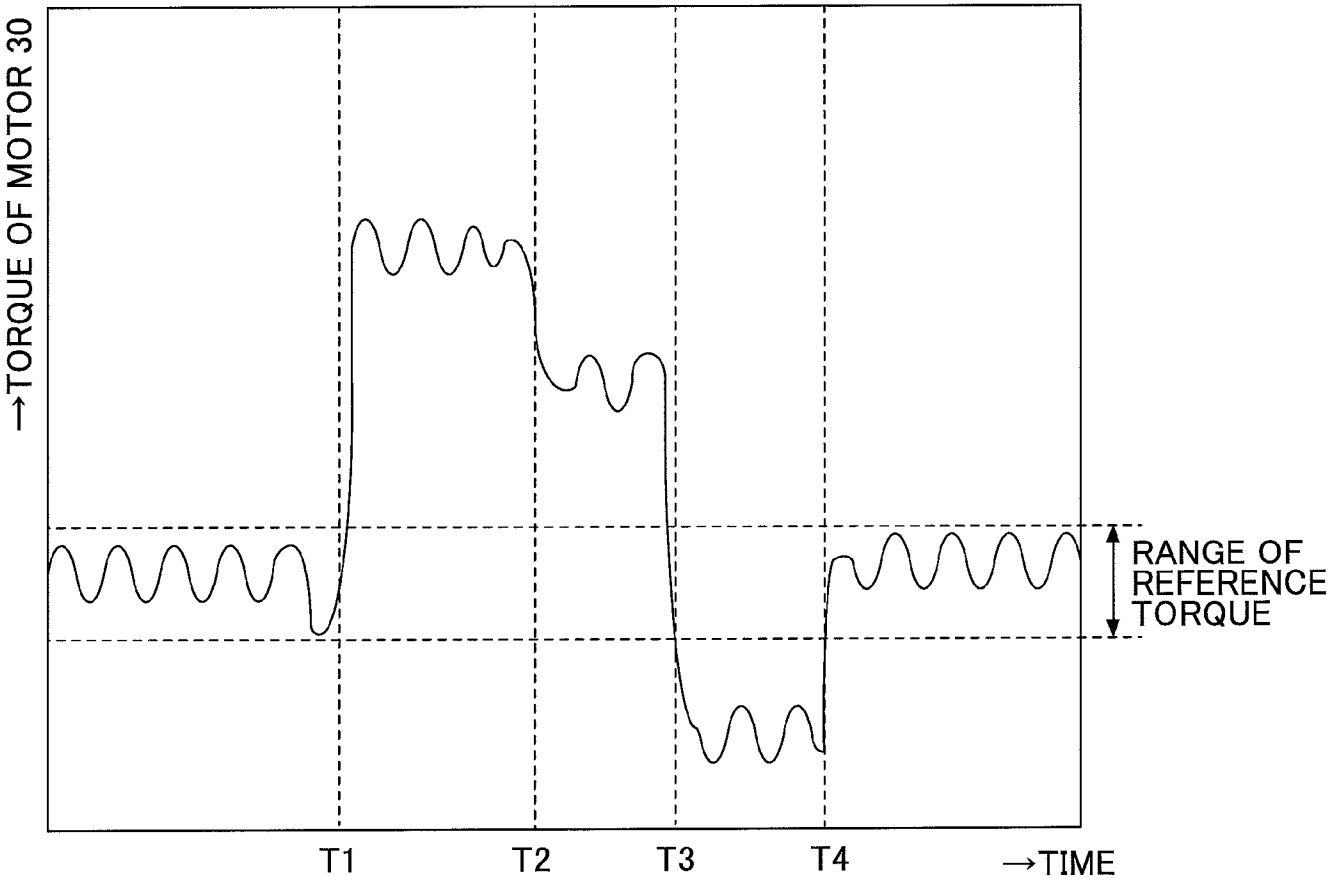
FIG. 11 is a schematic diagram illustrating changes of a torque of a motor in a case where a sheet of paper is being conveyed in a paper conveying apparatus according to the third embodiment of the present invention.

FIG. 11 is a schematic diagram illustrating changes of the torque of the motor 30 in a case where the paper P is being conveyed in the paper conveying apparatus 300 of the third embodiment.

In the example of FIG. 11, the paper P enters an area between the conveying rollers 21, 22 at time T1. Further, the paper P is conveyed by the pair of conveying rollers 21, 22 and the upper conveying unit 41 during a period between time T1 and time T2. Further, the paper P is conveyed only by the pair of conveying rollers 21, 22 during a period between time T2 and time T3. Further, the paper P enters the downstream conveying unit 42 (i.e. area between the conveying rollers 25, 26) at time T3. Further, the paper P is conveyed by the downstream conveying unit 42 and the pair of conveying rollers 21, 22 during a period between T3 and time T4. Further, the paper P passes the area between the conveying rollers 21, 22 at time T4.

The motor driving unit 32 controls at least one of the motors 30, 33, so that a target paper conveying speed of the conveying rollers 21, 22 (speed desired for conveying the paper P with the conveying rollers 21, 22) is greater than or equal to a paper conveying speed of the upstream conveying unit 41 in a state where the paper P is being fed from the upper conveying unit 41 to the conveying rollers 21, 22 and conveyed by the upstream conveying unit 41 and the pair of conveying rollers 21, 22.

Further, the motor driving unit 32 controls at least one of the motors 30, 34, so that the target paper conveying speed of the conveying rollers 21, 22 is less than or equal to a paper conveying speed of the downstream conveying unit 42 in a state where the paper P is being fed from the conveying rollers 21, 22 to the downstream conveying unit 42 and conveyed by the pair of conveying rollers 21, 22 and the downstream conveying unit 42.

By controlling the motors 30, 33, 34 with the motor driving part 32 as described above, the torque during the period between time T1 and time T2 increases because the paper P being conveyed by the conveying rollers 21, 22 is pulled in a direction opposite to the paper conveying direction by the upstream conveying unit 41. This is due to the difference between the paper conveying speed of the conveying rollers 21, 22 and the paper conveying speed of the upstream conveying unit 41. Further, the torque during the period between time T3 and time T4 decreases because the paper P being conveyed by the conveying rollers 21, 22 is pulled in the paper conveying direction by the downstream conveying unit 42. This is also due to the difference between the paper conveying speed of the conveying rollers 21, 22 and the paper conveying speed of the downstream conveying unit 42.

Accordingly, the torque of the motor 30 changes significantly (increase of fluctuation range) during the conveying of the paper P by the conveying rollers 21, 22. This significant change of torque enables difference of torque to be easily detected in comparison with the reference torque. Thereby, the paper P conveyed by the conveying rollers 21, 22 can be easily and positively detected. For example, even in a case where a type of paper P (e.g., thin paper) causing a small amount of torque change is conveyed by the conveying rollers 21, 22, the paper P can be positively detected.

It is to be noted that the range of the reference torque is set to include both the maximum and minimum values of the torque of the motor 30 in a state where the paper P is not conveyed by the conveying rollers 21, 22. Further, the range of the reference torque including the maximum and minimum values of the torque of the motor 30 is stored in the storage unit 51. Accordingly, the paper detecting unit 52 can detect the paper P by comparing the range of the reference torque with the calculation results of the torque calculating unit 51 when the paper P is being conveyed.

<Conveying Status Detection Process>

Figure 12:
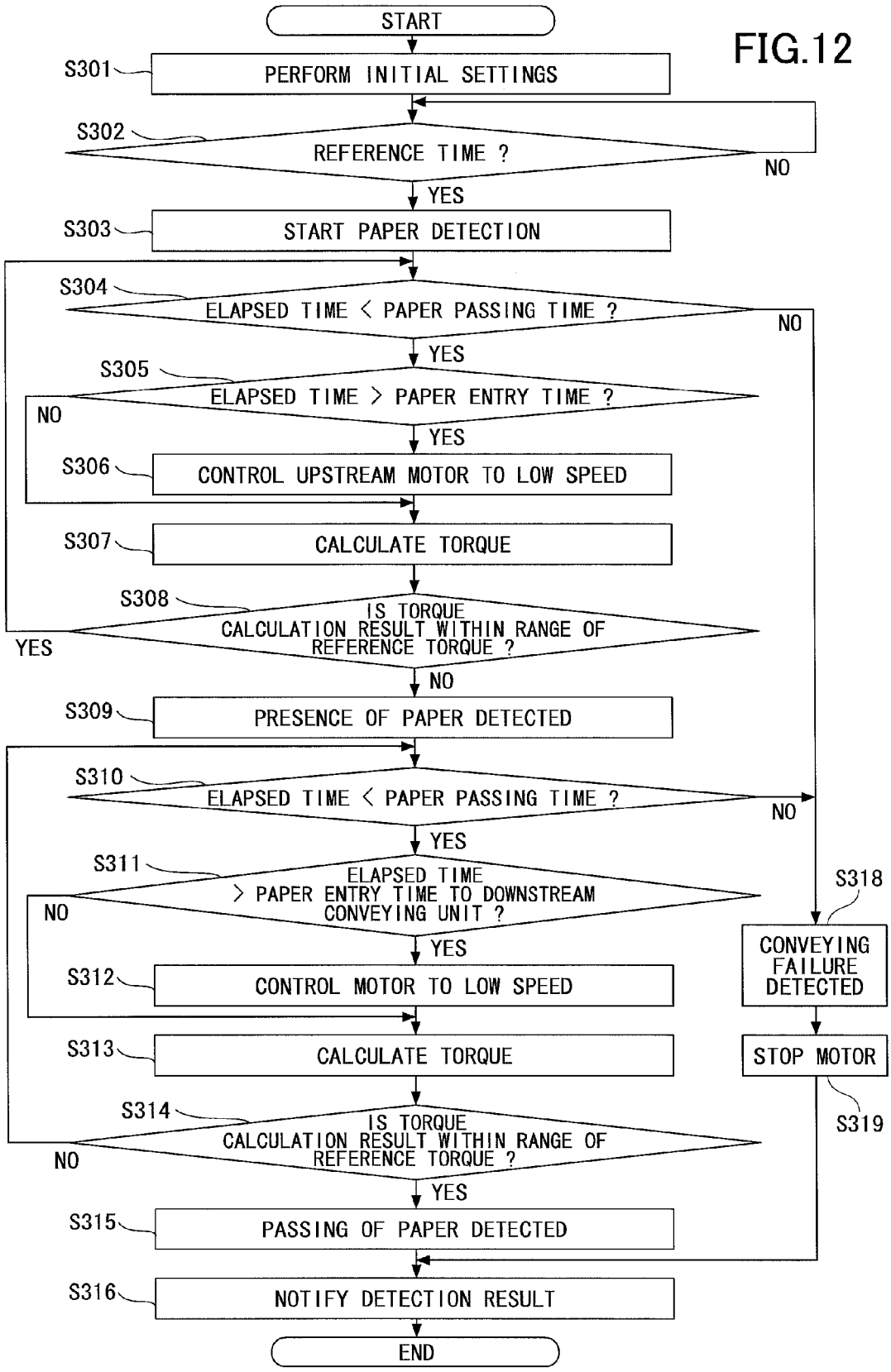
FIG. 12 is a flowchart illustrating a process for detecting a paper conveying status of a paper conveying apparatus according to the third embodiment of the present invention.

FIG. 12 is a flowchart illustrating a process for detecting the paper conveying status of the paper conveying apparatus 300 of the third embodiment.

At the time of beginning the conveying of the paper P with the paper conveying apparatus 300 of the third embodiment, first, initial settings are performed (Step S301). In the initial settings of Step S301, the paper detecting unit 52 reads out the range of reference torque (reference torque range) from the storage unit 53. Then, the time estimating unit 55 sets a reference times and estimates the time in which the paper P reaches the area between the conveying rollers 21, 22 with respect to the reference time, the time in which the paper P passes the conveying rollers 21, 22 with respect to the reference time, and the time in which the paper P reaches the downstream conveying unit 42 (i.e. area between the conveying rollers 25, 26).

Then, it is determined whether the reference time has been reached (Step S302). In a case of reaching the reference time (Yes in Step S302), the torque calculating unit 51 begins to calculate the torque of the motor 30, and the paper detecting unit 52 begins detection of the paper P (Step S303). Then, in Step S304, the time elapsed from the reference time (elapsed time) is compared with the time in which the paper is estimated to pass the conveying rollers 21, 22 (paper passing time). Then, in Step S305, the time elapsed from the reference time (elapsed time) is compared with the time in which the paper is estimated to enter the area between the conveying rollers 21, 22 (paper entry time to the conveying rollers 21, 22). If the paper P is being regularly conveyed in a case where the elapsed time is greater than the paper entry time to the conveying rollers 21, 22 (Yes in Step S305), it is determined that the paper P is being conveyed by both the upstream conveying unit 41 and the pair of conveying rollers 21, 22. In this case, the motor driving unit 32 controls the motor 33 of the upstream conveying unit 41 to a low speed relative to the motor 30, so that a target paper conveying speed of the upstream conveying unit 41 is less than or equal to the paper conveying speed of the conveying rollers 21, 22 (Step S306).

Then, in a state where the motors 30, 33 are controlled by the motor driving unit 32 in the above-described manner, the torque of the motor 30 is calculated (Step S307). Then, the paper detecting unit 52 compares the torque calculation result with the reference torque range (Step S308). In a case where the torque calculation result is not within the reference torque range (out of the reference torque range) (No in Step S308), the paper detecting unit 52 determines that the paper P is being conveyed in the area between the conveying rollers 21, 22 (Step S309).

Then, in a case where the elapsed time is less than the paper passing time (Yes in Step S310), the time elapsed from the reference time (elapsed time) is compared with the time in which the paper is estimated to enter the downstream conveying unit 42 (area between the conveying rollers 25, 26 (paper entry time to the downstream conveying unit 42). If the paper P is being regularly conveyed in a case where the elapsed time is greater than the paper entry time to the downstream conveying unit 42 (Yes in Step S311), it is determined that the paper P has entered the area between the conveying rollers 25, 26 of the downstream conveying unit 42 and is being conveyed by both the downstream conveying unit 42 and the pair of conveying rollers 21, 22. In this case, the motor driving unit 32 controls the motor 30 to a low speed relative to the motor 34 of the downstream conveying unit 42, so that a target paper conveying speed of the conveying rollers 21, 22 is less than or equal to the paper conveying speed of the downstream conveying unit 42 (Step S312).

Then, in a state where the motors 30, 34 are controlled by the motor driving unit 32 in the above-described manner, the torque of the motor 30 is calculated (Step S313). Then, the paper detecting unit 52 compares the torque calculation result with the reference torque range (Step S314). In a case where the torque calculation result is within the reference torque range (Yes in Step S314), the paper detecting unit 52 determines that the paper P has passed the area between the rollers 21, 22 (Step S315).

In a case where the conveying of the paper P by the conveying rollers 21, 22 is detected in FIG. S309 and the passing of the paper P is detected in Step S215, the notifying unit 54 notifies that the paper P has been regularly conveyed (Step S216) to, for example, an external device (e.g., server or the like) outside of the paper conveying apparatus 300 via a network.

If the torque calculation result is within the reference torque range (Yes in Step S308) in a case where time has elapsed beyond the paper passing time (No in Step S304), it is determined that conveying failure has occurred before the paper P has reached the area between the conveying rollers 21, 22. Therefore, in this case, the conveying status detecting unit 56 determines that conveying failure has occurred (Step S318). Accordingly, the motor 30 is stopped (Step S319). Then, the notifying unit 54 notifies, for example, a server or the like that conveying failure has been detected (Step S316). Thereby, the process of detecting the conveying status is terminated.

Further, if the torque calculation result is not within the reference torque range (No in Step S314) in a case where time has elapsed beyond the paper passing time (No in Step S310) after the paper P has entered the area between the conveying rollers 25, 26 of the downstream conveying unit 42 (Yes in Step S311), it is determined that conveying failure has occurred at the area between the conveying rollers 21, 22. Therefore, in this case, the conveying status detecting unit 56 determines that conveying failure has occurred (Step S318). Accordingly, the motor 30 is stopped (Step S319). Then, the notifying unit 54 notifies, for example, a server or the like that a conveying failure has been detected (Step S316). Thereby, the process of detecting the conveying status is terminated.

Thus, by providing the upstream and downstream conveying units 41, 42 and using the motor driving unit 32 to control the rotation speed of the motors 30, 33, 34 according to conveying status, the torque fluctuation range of the motor 30 can be increased. By increasing the torque fluctuation range of the motor 30, the sensitivity of detecting the paper P conveyed by the conveying rollers 21, 22 can be improved.

Alternatively, the rotation speed of the motors 30, 33, 34 may be controlled to constantly satisfy a relationship of "target paper conveying speed of the upstream conveying unit 41 (conveying rollers 23, 24)≤target paper conveying speed of the conveying rollers 21, 22≤target paper conveying speed of the downstream conveying unit 42 (conveying rollers 25, 26)" regardless of the conveying state of the paper P.

[Fourth Embodiment]

Next, a paper conveying apparatus 400 according to the fourth embodiment of the present invention is described. In the fourth embodiment of the present invention, components corresponding to the above-described paper conveying apparatuses 100, 200, 300 of the first to third embodiments are denoted with like reference numerals, and are not further explained.

<Configuration of Paper Conveying Apparatus>

Figure 13:
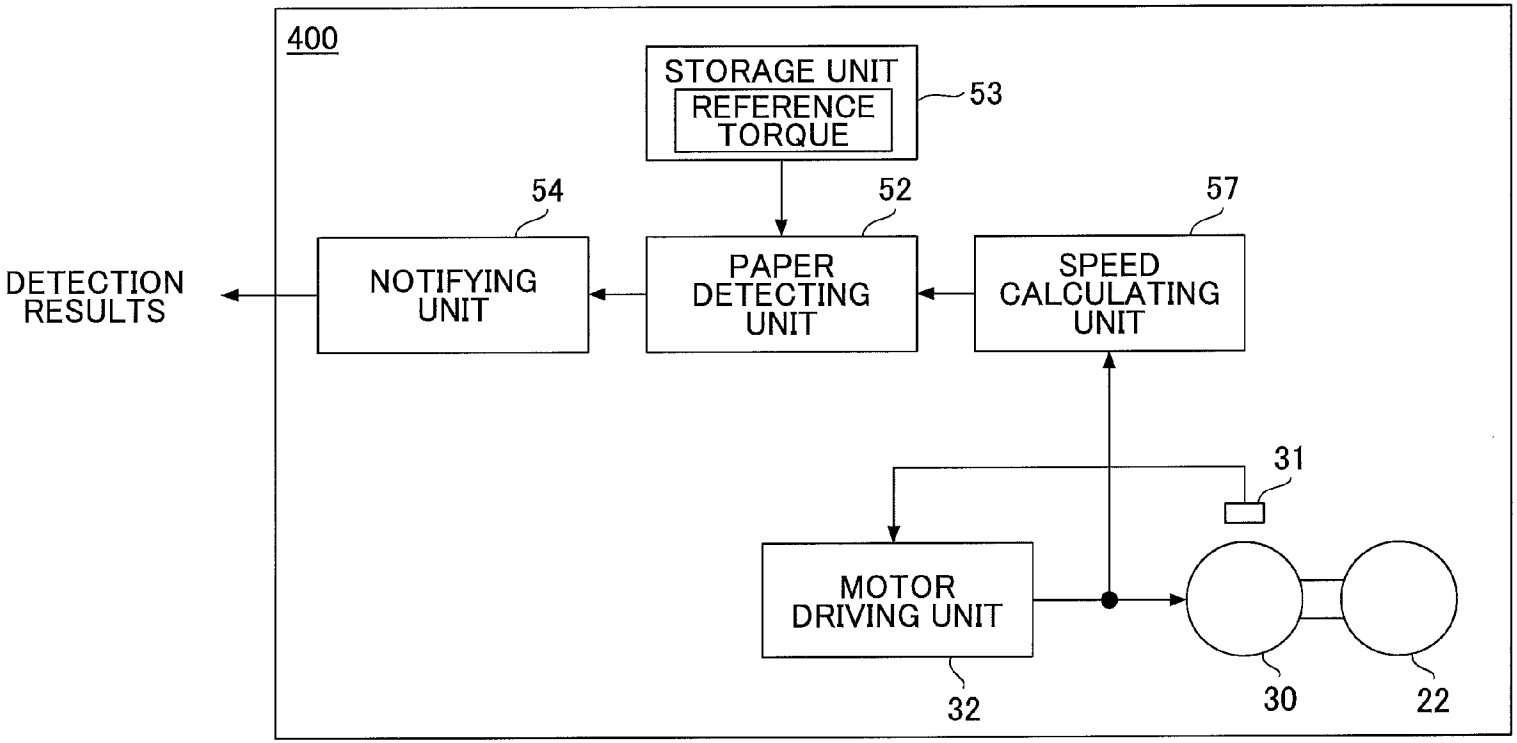
FIG. 13 is a block diagram illustrating a configuration of function parts of a paper conveying apparatus according to the fourth embodiment of the present invention.

FIG. 13 is a block diagram illustrating a configuration of function parts of the paper conveying apparatus 400 according to the fourth embodiment of the present invention.

As illustrated in FIG. 13, the difference between the paper conveying apparatus 400 of the fourth embodiment and the paper conveying apparatus 100 of the first embodiment is that the paper conveying apparatus 400 includes a speed calculating unit 57 for calculating the rotation speed of the motor 30 based on the signals output from the encoder 31. It is to be noted that the speed calculating unit 57 is another example of a parameter calculating unit that calculates a parameter(s) and a reference parameter(s) of the motor 30. In this embodiment, the parameter includes the rotation speed of the motor 30 and the below-described reference speed (reference speed range) of the motor 30. Further, the difference between the paper conveying apparatus 400 of the fourth embodiment and the paper conveying apparatus 100 of the first embodiment is that the range of reference speed (reference speed range) is set beforehand based on a rotation speed of the motor 30 controlled by the motor driving unit 32 in a state where the paper P is not conveyed. Further, the difference between the paper conveying apparatus 400 of the fourth embodiment and the paper conveying apparatus 100 of the first embodiment is that the reference speed range is stored in the storage unit 53.

<Paper Detection>

Figure 14:
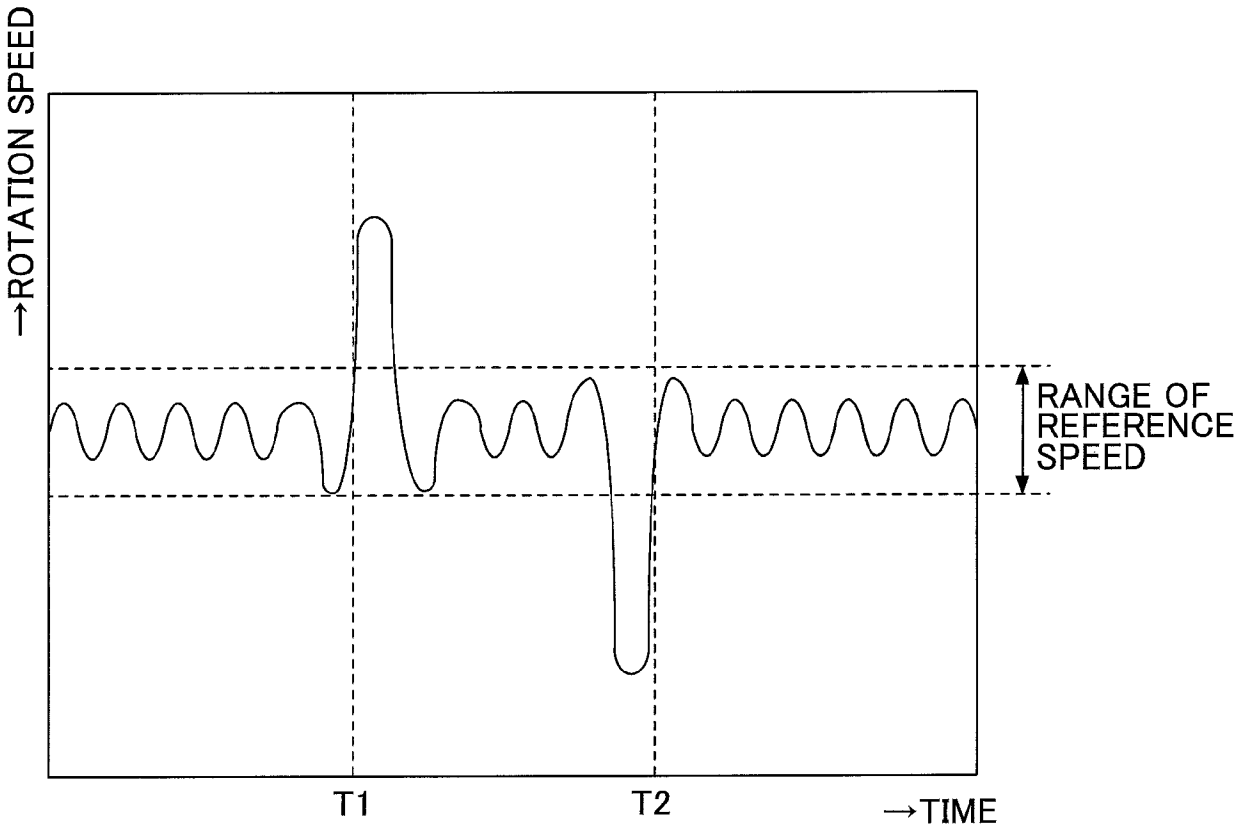
FIG. 14 is a schematic diagram illustrating changes of a rotation speed of a motor in a case where a sheet of paper is being conveyed in a paper conveying apparatus according to the fourth embodiment of the present invention.

FIG. 14 is a schematic diagram illustrating changes of the rotation speed of the motor 30 in a case where the paper P is being conveyed in the paper conveying apparatus 400 of the fourth embodiment.

FIG. 14 illustrates an example of changes of the rotation speed of the motor 30 in a case where the paper P enters an area between the conveying rollers 21, 22 at time T1, and the paper P passes the area between the conveying rollers 21, 22 at time T2.

The rotation of the motor 30 is controlled to a target rotation speed by the motor driving unit 32. However, at the time when the paper P enters the area between the conveying rollers 21, 22, the rotation speed of the motor 30 may increase due to, for example, the paper P being slightly pushed forward. Further, at the time when the paper P passes the area between the conveying rollers 21, 22, the rotation speed of the motor 30 may decrease due to, for example, the paper P abutting a conveying unit (not illustrated) located downstream of the conveying rollers 21, 22.

Accordingly, by setting the reference speed range based on the rotation speed of the motor 30 in a state where the paper P is not conveyed by the conveying rollers 21, 22, and comparing the rotation speed of the motor 30 with the reference speed range, the paper P being conveyed by the conveying rollers 21, 22 can be detected.

<Paper Detection Process>

Figure 15:
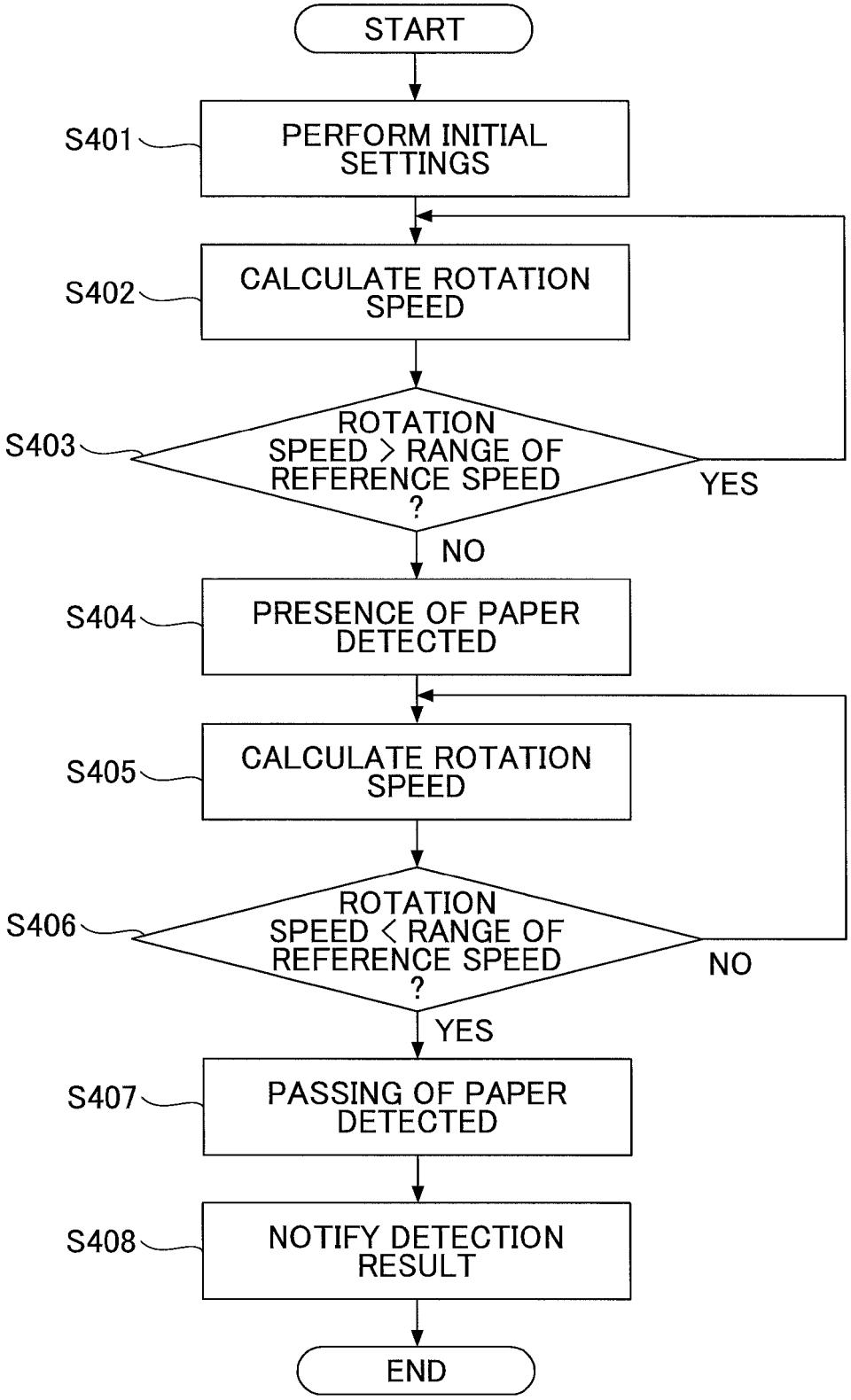
FIG. 15 is a flowchart illustrating a paper detection process by a paper conveying apparatus according to the fourth embodiment of the present invention.

FIG. 15 is a flowchart illustrating a paper detection process by the paper conveying apparatus 400 of the fourth embodiment.

In a case of conveying the paper P with the paper conveying apparatus 400, first, initial setting is performed (Step S401). In Step S401, the paper detecting unit 52 reads out a reference speed range from the storage unit 53. Then, the speed calculating unit 57 calculates a rotation speed of the motor 30 being driven to rotate by the motor driving unit 32 (Step S402). Then, the paper detecting unit 52 compares the result of the calculation (speed calculation result) of the speed calculating unit 57 with the reference speed range (Step S403). In a case where the speed calculation result is not within the reference speed range, that is, the speed calculation result being greater than a maximum value of the reference speed range (No in Step S403), the paper detecting unit 52 determines that the paper P is being conveyed by the conveying rollers 21, 22 (Step S404).

Then, the speed calculating unit 57 continues to calculate the rotation speed of the motor 30 (Step S405). Then, the paper detecting unit 52 compares the result of the calculation (speed calculation result) of the speed calculating unit 57 with the reference speed range (Step S406). In a case where the speed calculation result is not within the reference speed range, that is, the speed calculation result being less than a minimum value of the reference speed range (Yes in Step S406), the paper detecting unit 52 determines that the paper P has passed the area between the conveying rollers 21, 22 (Step S407). Then, the notifying unit 54 notifies the result of the determination (detection result) of the paper detecting unit 52 to, for example, a server or the like (Step S408). Thereby, the paper detection process is terminated.

Accordingly, by calculating the speed of the motor 30 for rotating the conveying roller 22 and comparing the calculated rotation speed with the reference speed range (obtained when the paper P is not conveyed by the conveying rollers 21, 22), detection of the paper P conveyed by the conveying rollers 21, 22 can be performed.

[Fifth Embodiment]

Next, an image forming apparatus 500 according to the fifth embodiment of the present invention is described. In the fifth embodiment of the present invention, components corresponding to those of the above-described paper conveying apparatuses 100, 200, 300, 400 of the first to fourth embodiments are denoted with like reference numerals, and are not further explained.

Figure 16:
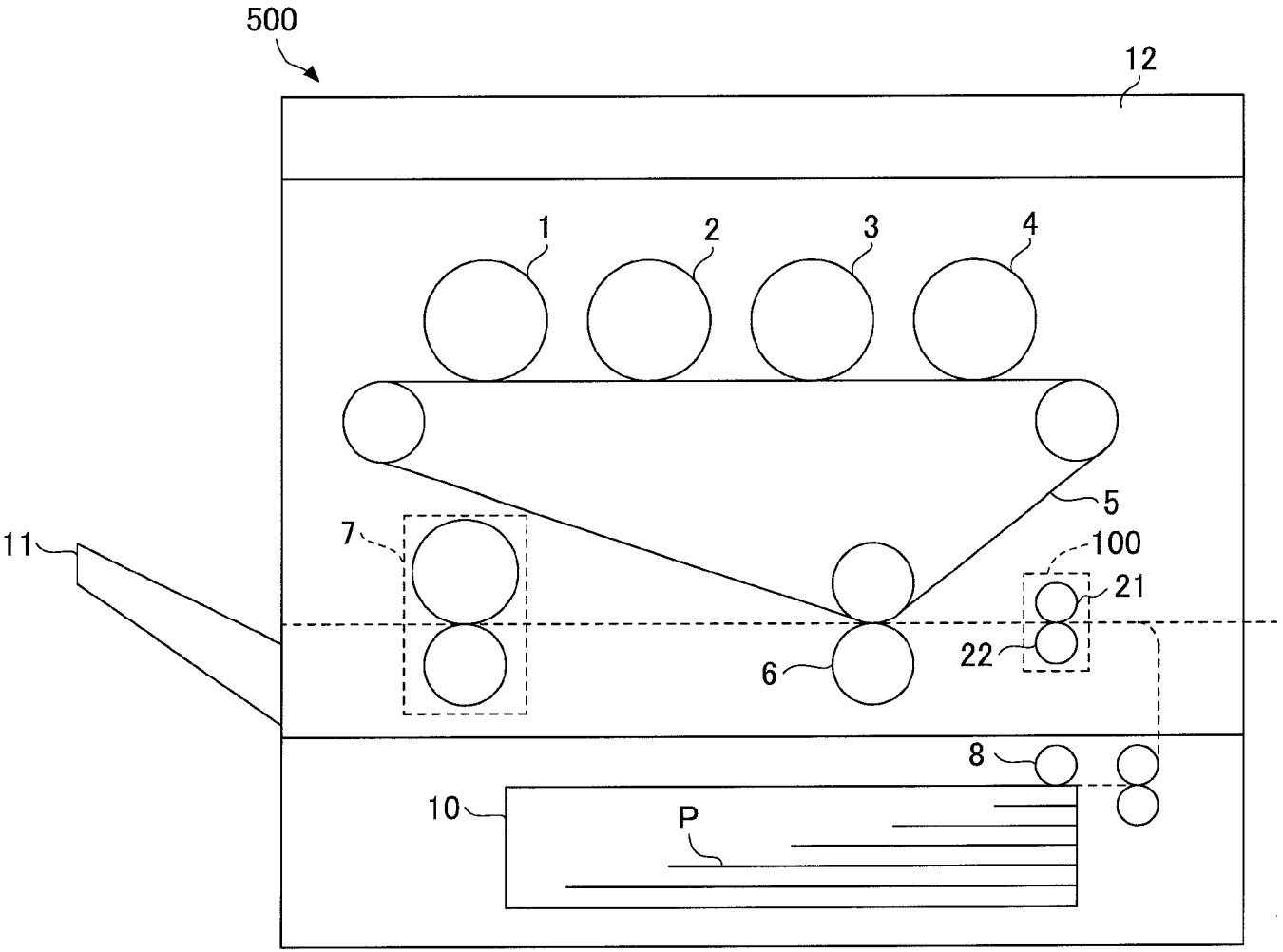
FIG. 16 is a schematic diagram illustrating a configuration of an image forming apparatus according to the fifth embodiment of the present invention.

FIG. 16 is a schematic diagram illustrating a configuration of an image forming apparatus 500 according to the fifth embodiment of the present invention. Although the image forming apparatus 500 illustrated in FIG. 16 is a full color image forming apparatus using an electrophotographic method, the image forming apparatus 500 may be, for example, a monotone image forming apparatus or an inkjet type image forming apparatus.

As illustrated in FIG. 16, the image forming apparatus 500 includes, for example, photoconductors 1-4, an intermediate transfer belt 5, a secondary transfer roller 6, a fixing apparatus 7, and a scanner unit 12. With this configuration, the image forming apparatus 500 forms a full color image(s) on the paper P.

The photoconductors 1-4, which have charging devices, developing devices, and the like arranged in their periphery, have toner images of different colors formed on their surfaces. The toner images are superposed and transferred to the intermediate transfer belt 5. A sheet of paper P is conveyed by, for example, a sheet-feeding roller 8 from a paper tray 10 to an area between the intermediate transfer belt 5 and the secondary transfer roller 6. The toner images, which are transferred to the intermediate transfer belt 5, are further transferred to the paper P at the area between the intermediate transfer belt 5 and the secondary transfer roller 6 (secondary transfer). Then, the paper is conveyed to the fixing apparatus 7. The fixing device fixes the toner images onto the surface of the paper P. Then, the paper P is discharged from a sheet discharge tray 11.

In this embodiment, the image forming apparatus 500 has the paper conveying apparatus 100 of the first embodiment provided in a conveying path of the image forming apparatus 500 for conveying the paper P thereon. As described above, with the paper conveying apparatus 100, the paper P passing the area between the conveying rollers 21, 22 can be detected. Accordingly, the paper P can be detected without requiring paper detection sensors or the like for detecting the paper P. In other words, the paper P can be detected with a simple configuration.

The position of the paper conveying apparatus 100 is not limited to the configuration illustrated in FIG. 16. For example, the paper conveying apparatus 100 may be positioned in back of the paper tray 10 or between the secondary transfer roller 6 and the fixing apparatus 7. In a case where the scanner unit 12 includes a paper conveying part, the paper conveying apparatus 100 may be provided in the paper conveying part of the scanner unit 12. Further, in a case where the image forming apparatus 500 includes multiple conveying paths, multiple paper conveying apparatus 100 may be provided in the multiple conveying paths of the image forming apparatus 500.

Alternatively, the paper conveying apparatus 100 provided in the image forming apparatus 500 may be replaced by any one of the above-described paper conveying apparatuses 200, 300, 400 of the second-fourth embodiments. Even where the paper conveying apparatus 100 is replaced by any one of the above-described paper conveying apparatuses 200, 300, 400 of the second-fourth embodiments, the conveying position and the conveying status (e.g., conveying failure) of the paper P conveyed on the conveying path of the image forming apparatus 200 can be detected.

[Sixth Embodiment]

Next, a medium conveying system 600 according to the sixth embodiment of the present invention is described.

Figure 17:
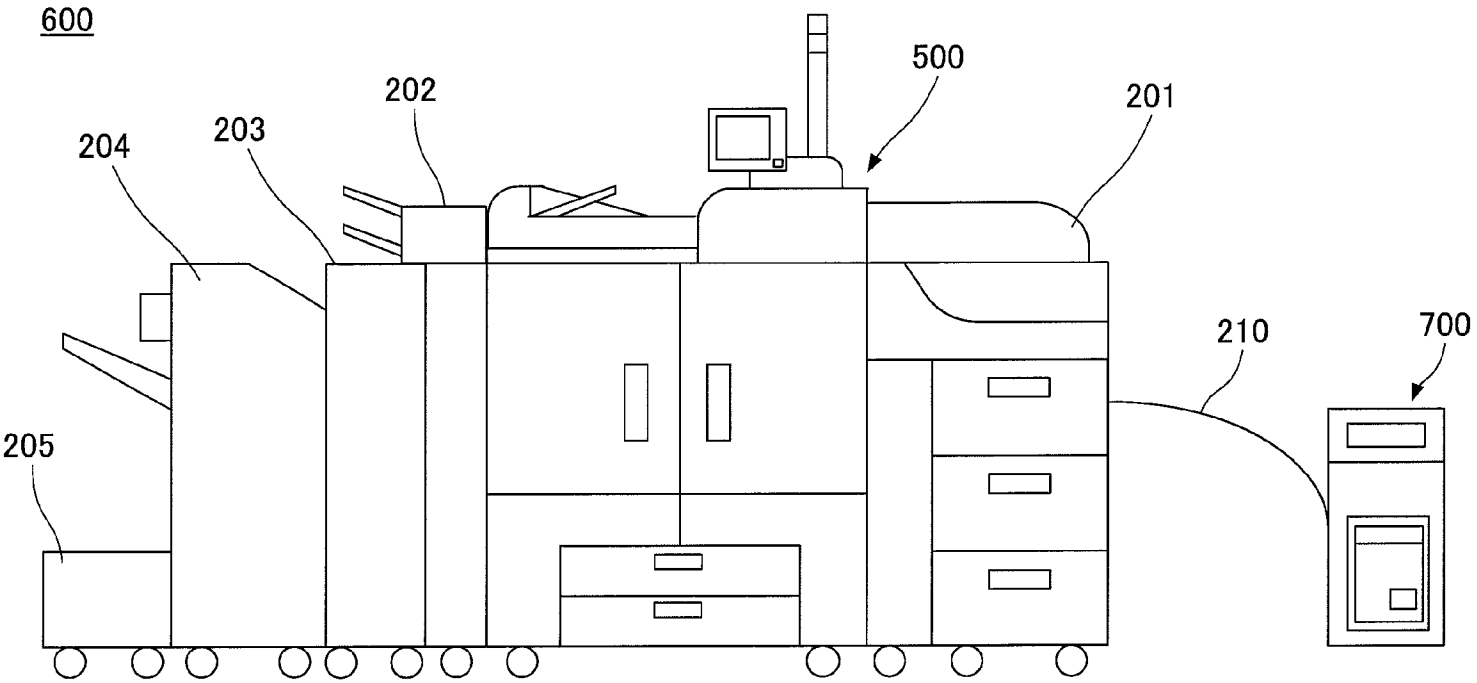
FIG. 17 is a schematic diagram illustrating a medium conveying system according to the sixth embodiment of the present invention.

FIG. 17 is a schematic diagram illustrating the medium conveying system 600 of the sixth embodiment. In the sixth embodiment of the present invention, components corresponding to those of the above-described paper conveying apparatuses 100, 200, 300, 400 of the first to fourth embodiments or the image forming apparatus 500 of the fifth embodiment are denoted with like reference numerals, and are not further explained.

FIG. 17 is a schematic diagram illustrating en external configuration of the medium conveying system 600 of the sixth embodiment.

The medium conveying system 600 may be, for example, an image forming system including a so-called "production printing system". In the production printing system, peripheral devices having various functions (e.g., paper-feeding, folding, stapling, cutting) are assembled to the image forming apparatus 500 according to, for example, the purpose of the user. For example, the medium conveying system 600 of the sixth embodiment has a mass sheet feeding unit 201, an inserter 202, a folding unit 203, a finisher (including, for example, a stapler, a hole-puncher) 204, a cutting machine 205, and a server apparatus 700 connected to the image forming apparatus 500. The image forming apparatus 200 has a conveying unit 203 including, for example, the conveying rollers 20, 21 and the motor 30 illustrated in FIG. 1.

Figure 18:
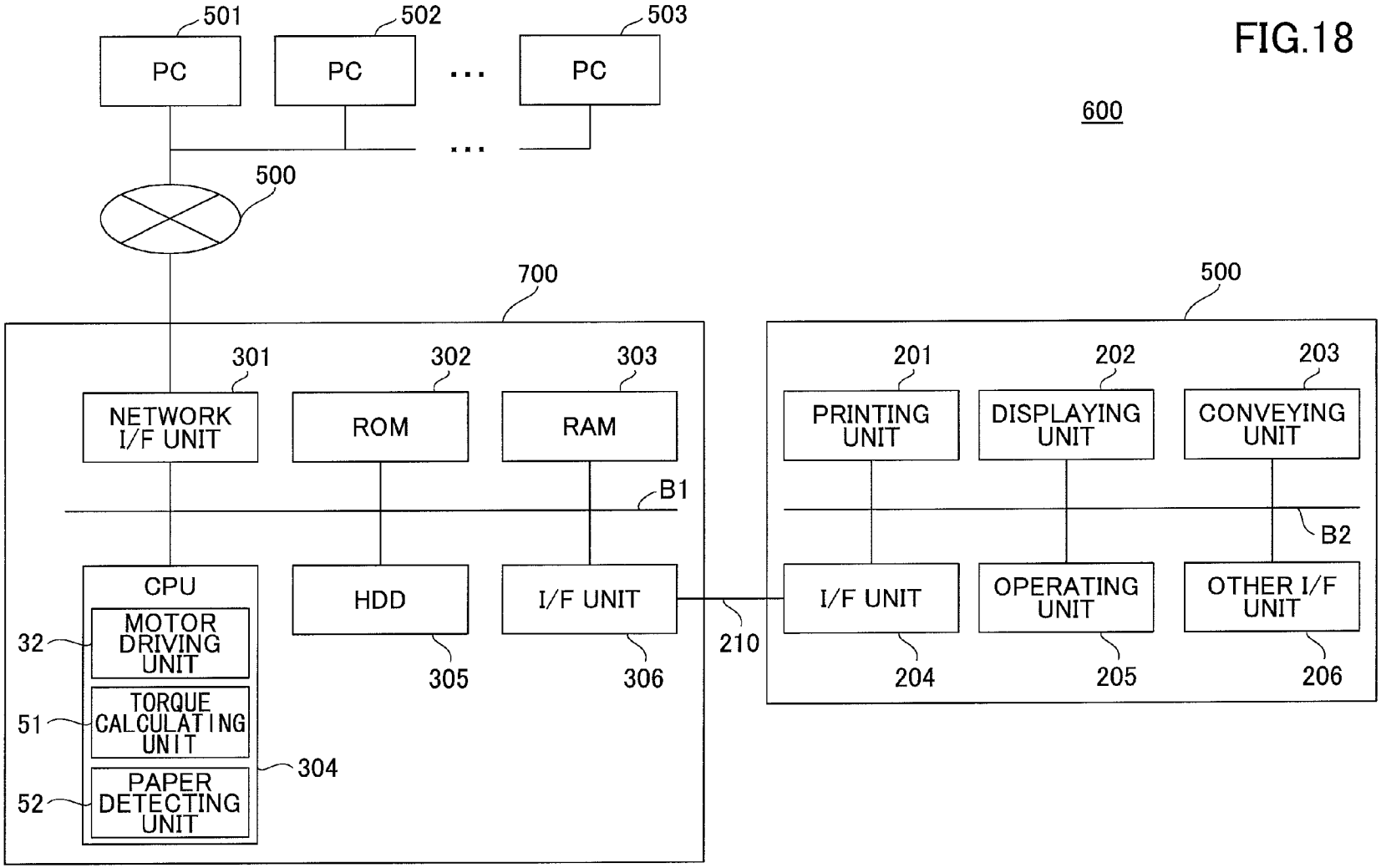
FIG. 18 is a schematic diagram illustrating a hardware configuration of a medium conveying system according to the sixth embodiment of the present invention.

FIG. 18 is a schematic diagram illustrating a hardware configuration of the medium conveying system 600 of the sixth embodiment.

The server apparatus 700 includes, a network I/F unit 301, a ROM 302, a RAM 303, a CPU 304, a HDD 305, and an I/F unit 306 that are connected to each other by a bus B1. Further, the server apparatus 700 is connected to the image forming apparatus 500 by way of a dedicated line 210.

The CPU 304 of the server apparatus 700 is an operation device that performs controls and calculation/processing of data inside a computer. The CPU 304 executes programs stored in, for example, the ROM 302 and the RAM 303. By executing the programs, the CPU 304 controls the entire server apparatus 700 and implements the functions of, for example, the motor driving unit 32, the torque calculating unit 51, the paper detecting unit 52 for the conveying unit 203 of the image forming apparatus 500.

The HDD 305 is a non-volatile storage device that stores various programs and data therein. The programs and data stored by the HDD 305 include, for example, an OS (Operating System) and applications for providing various functions.

The ROM 302 is a non-volatile semiconductor memory (storage device) that stores data (e.g., internal data of the server apparatus 700) therein even after power is turned off. Further, the RAM 303 is a volatile semiconductor memory (storage device) that temporarily stores, for example, programs and data therein. For example, the reference torque of the conveying unit 203 of the image forming apparatus 500 is stored in the RAM 303.

The network I/F unit 301 is an interface for communicating with one or more peripheral devices (e.g., PC (Personal Computer) 501) having a communication function by way of a network 500 (e.g., LAN (Local Area Network), WAN (Wide Area Network)) constituted by wired and/or wireless data transmission paths.

The I/F unit 306 is an interface for connecting the server apparatus 700 to the image forming apparatus 500. The I/F unit 306 is connected to the below-described I/F unit 204 of the image forming apparatus 500 by way of the dedicated line 210.

As described above, the image forming apparatus 500 is connected to the server apparatus 700 by way of the dedicated line 210. The image forming apparatus 500 includes, for example, a printing unit 201, a displaying unit 202, the conveying unit 203, the I/F unit 204, an operating unit 205, and another I/F unit 206 that are connected to each other by a bus B2.

The printing unit 201 includes, for example, a photoconductor unit (not illustrated) and a fixing apparatus (not illustrated). The printing unit 201 forms images on a surface of the paper P based on image data.

The displaying unit 202 and the operating unit 205 include, for example, a LCD (Liquid Crystal Display) having a key switch (hard key) function and a touch panel function (including software keys of a GUI (Graphical User Interface)). The displaying unit 202 and the operating unit 205 is a display device and/or an input device that functions as a UI (User Interface) when using the functions of the image forming apparatus 500.

The conveying unit 203 includes the above-described conveying rollers 21, 22 and the motor 30 for conveying the paper P.

The I/F unit 204 is an interface for connecting the image forming apparatus 500 to the server apparatus 700. The I/F unit 204 is connected to the I/F unit 306 of the server apparatus 700 by way of the dedicated line 210.

With the image forming apparatus 600 having the above-described configuration, the motor 30 provided in the conveying unit 203 of the image forming apparatus 500 can be controlled by the motor driving unit 32 of the server apparatus 700, and the torque of the motor 30 can be calculated by the torque calculating unit 51 of the server apparatus 700. As described above in the first embodiment, the paper detecting unit 52 of the image forming apparatus 500 can detect the paper P conveyed by the conveying rollers 21, 22 based on torque calculation results calculated by the torque calculating unit 51.

It is preferable to connect the image forming apparatus 500 and the server apparatus 700 by way of the dedicated line 210 for controlling the motor 30 of the conveying unit 203 of the image forming apparatus 500 at high speed and detecting the paper P at high speed. Alternatively, the image forming apparatus 500 and the server apparatus 700 may be connected by way of a network or the like as long as controlling of the motor 30 and the detecting of the paper P can be performed at high speed.

Further, the above-described time estimating unit 55 and the conveying status detecting unit 56 of the second embodiment may also be provided in the server apparatus 300. Further, multiple conveying units 203 may be provided in the image forming apparatus 500. Alternatively, the above-described speed calculating unit 57 of the fourth embodiment may be provided in the server apparatus 700. With any one of the above-described examples of the configuration of the server apparatus 700, the conveying position and the conveying status (e.g., conveying failure) of the paper P conveyed on the conveying path of the conveying unit 203 of the image forming apparatus 500 can be detected.

Alternatively, one or more of, for example, the motor driving unit 32, the torque calculating unit 51, the paper detecting unit 52, the time estimating unit 55, the conveying status detecting unit 56, and the speed calculating unit 57 provided in the server apparatus 700 may be provided in the image forming apparatus 500. Alternatively, one or more of, for example, the motor driving unit 32, the torque calculating unit 51, the paper detecting unit 52, the time estimating unit 55, the conveying status detecting unit 56, and the speed calculating unit 57 provided in the server apparatus 700 may be provided in the PC 501 connected to the server 700 by way of the network 500 or the like.

For example, the server apparatus 700 may be an apparatus installed with a RIP (Raster Image Processor) for generating raster data that can be printed by the image forming apparatus 500.

Further, the present invention is not limited to these embodiments, but variations and modifications may be made without departing from the scope of the present invention.

What is claimed is:

1. A medium conveying apparatus comprising:

a conveying unit including two rotating members for conveying a medium therebetween;

a driving unit configured to drive a rotation of at least one of the two rotating members;

an upstream conveying unit configured to convey the medium to the conveying unit;

a downstream conveying unit configured to receive the medium conveyed from the conveying unit; and a conveying status detecting unit configured to determine a conveyance status of the medium based on a driving torque of the driving unit;

wherein the conveying unit is configured to convey the medium at a reference speed, said reference speed being faster than the upstream conveying unit at least when the medium is conveyed from the upstream conveying unit, and said reference speed being slower than the downstream conveying unit at least when the medium is conveyed to the downstream conveying unit; and wherein the conveyance status of the medium is detected by the comparison of a prescribed reference torque to the driving torque of the driving unit at least when the medium is conveyed between the upstream conveying unit and the conveying unit or when the medium is conveyed between the conveying unit and the downstream conveying unit.

2. The medium conveying apparatus as claimed in claim 1, wherein a conveying reference speed of the upstream conveying unit is slower than a conveying reference speed of the conveying unit, and wherein the conveying reference speed of the conveying unit is slower than a conveying reference speed of the downstream conveying unit.

3. The medium conveying apparatus as claimed in claim 1, wherein the prescribed reference torque is a driving torque of the conveying unit when the conveying unit is not conveying the print medium.

4. The medium conveying apparatus as claimed in claim 1, wherein the driving unit is configured to drive such that a conveying speed of the medium caused by the conveying unit becomes equal to or greater than a conveying speed of the medium caused by the upstream conveying unit when the medium is conveyed from the upstream conveying unit to the conveying unit, and the conveying speed of the medium caused by the conveying unit becomes equal to or less than a conveying speed of the medium caused by the downstream conveying unit when the medium is conveyed from the conveying unit to the downstream conveying unit, further comprising:

a torque calculation unit that calculates the driving torque of the driving unit; and a medium detection unit that is configured to detect conveyance of the medium to the conveying unit based on a comparison of the driving torque of the driving unit calculated by the torque calculation unit to a driving torque calculated by the torque calculation unit when the conveying unit does not convey the medium.

5. The medium conveying apparatus as claimed in claim 1, comprising:

a time estimation unit configured to estimate a time for the medium to pass through the conveying unit; and a conveyance failure detection unit that determines a case where the medium detecting unit has not detected the medium by the time estimated by the time estimation unit to be a conveyance failure, or that determines a case where the medium detecting unit has detected the medium after the time estimated by the time estimation unit to be a conveyance failure.

6. An image forming apparatus comprising the medium conveying apparatus of claim 1.

7. A medium conveying system comprising:

a medium conveying apparatus including:

a conveying unit including two rotating members for conveying a medium therebetween;

a driving unit configured to drive a rotation of at least one of the two rotating members;

an upstream conveying unit configured to convey the medium to the conveying unit;

a downstream conveying unit configured to receive the medium conveyed from the conveying unit; and a conveying status detecting unit configured to determine a conveyance status of the medium based on a driving torque of the driving unit; and a server apparatus connected to the medium conveying apparatus;

wherein the conveying unit is configured to convey the medium at a reference speed, said reference speed being faster than the upstream conveying unit at least when the medium is conveyed from the upstream conveying unit, and said reference speed being slower than the downstream conveying unit at least when the medium is conveyed to the downstream conveying unit; and wherein the conveyance status of the medium is detected by the comparison of a prescribed reference torque to the driving torque of the driving unit at least when the medium is conveyed between the upstream conveying unit and the conveying unit or when the medium is conveyed between the conveying unit and the downstream conveying unit.

8. The medium conveying system as claimed in claim 7, wherein a conveying reference speed of the upstream conveying unit is slower than a conveying reference speed of the conveying unit, and wherein the conveying reference speed of the conveying unit is slower than a conveying reference speed of the downstream conveying unit.

9. The medium system apparatus as claimed in claim 7, wherein the prescribed reference torque is a driving torque of the conveying unit when the conveying unit is not conveying the print medium.

10. The medium conveying system as claimed in claim 7, wherein the driving unit is configured to drive such that a conveying speed of the medium caused by the conveying unit becomes equal to or greater than a conveying speed of the medium caused by the upstream conveying unit when the medium is conveyed from the upstream conveying unit to the conveying unit, and the conveying speed of the medium caused by the conveying unit becomes equal to or less than a conveying speed of the medium caused by the downstream conveying unit when the medium is conveyed from the conveying unit to the downstream conveying unit, further comprising:

a torque calculation unit that calculates the driving torque of the driving unit; and a medium detection unit that is configured to detect conveyance of the medium to the conveying unit based on a comparison of the driving torque of the driving unit calculated by the torque calculation unit to a driving torque calculated by the torque calculation unit when the conveying unit does not convey the medium.

11. The medium conveying system as claimed in claim 7, comprising:

a time estimation unit configured to estimate a time for the medium to pass through the conveying unit; and a conveyance failure detection unit that determines a case where the medium detecting unit has not detected the medium by the time estimated by the time estimation unit to be a conveyance failure, or that determines a case where the medium detecting unit has detected the medium after the time estimated by the time estimation unit to be a conveyance failure.

12. A medium conveying method comprising:

causing a conveying unit including two rotating members to convey a medium therebetween;

causing a driving unit to drive a rotation of at least one of the two rotating members;

causing an upstream conveying unit to convey the medium to the conveying unit;

causing a downstream conveying unit to receive the medium conveyed from the conveying unit; and causing a conveying status detecting unit to determine a conveyance status of the medium based on a driving torque of the driving unit;

wherein the conveying unit is configured to convey the medium at a reference speed, said reference speed being faster than the upstream conveying unit at least when the medium is conveyed from the upstream conveying unit, and said reference speed being slower than the downstream conveying unit at least when the medium is conveyed to the downstream conveying unit; and wherein the conveyance status of the medium is detected by the comparison of a prescribed reference torque to the driving torque of the driving unit at least when the medium is conveyed between the upstream conveying unit and the conveying unit or when the medium is conveyed between the conveying unit and the downstream conveying unit.

13. The medium conveying method as claimed in claim 12, wherein a conveying reference speed of the upstream conveying unit is slower than a conveying reference speed of the conveying unit, and wherein the conveying reference speed of the conveying unit is slower than a conveying reference speed of the downstream conveying unit.

14. The medium conveying method as claimed in claim 12, wherein the prescribed reference torque is a driving torque of the conveying unit when the conveying unit is not conveying the print medium.

15. The medium conveying method as claimed in claim 12, wherein the driving unit is configured to drive such that a conveying speed of the medium caused by the conveying unit becomes equal to or greater than a conveying speed of the medium caused by the upstream conveying unit when the medium is conveyed from the upstream conveying unit to the conveying unit, and the conveying speed of the medium caused by the conveying unit becomes equal to or less than a conveying speed of the medium caused by the downstream conveying unit when the medium is conveyed from the conveying unit to the downstream conveying unit, further comprising:

causing a torque calculation unit to calculate the driving torque of the driving unit; and causing a medium detection unit to detect conveyance of the medium to the conveying unit based on a comparison of the driving torque of the driving unit calculated by the torque calculation unit to a driving torque calculated by the torque calculation unit when the conveying unit does not convey the medium.

16. The medium conveying method as claimed in claim 12, comprising:

causing a time estimation unit to estimate a time for the medium to pass through the conveying unit; and causing a conveyance failure detection unit to determine a case where the medium detecting unit has not detected the medium by the time estimated by the time estimation unit to be a conveyance failure, or to determine a case where the medium detecting unit has detected the medium after the time estimated by the time estimation unit to be a conveyance failure.

* * * * *